US007781137B2

(12) United States Patent
Kakui et al.

(10) Patent No.: US 7,781,137 B2
(45) Date of Patent: Aug. 24, 2010

(54) METHOD AND APPARATUS FOR PRODUCING ELECTROPHOTOGRAPHIC PHOTORECEPTOR

(75) Inventors: Mikio Kakui, Nara (JP); Takatsugu Obata, Nara (JP); Masanori Kinomoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 1093 days.

(21) Appl. No.: 11/114,007

(22) Filed: Apr. 26, 2005

(65) Prior Publication Data

US 2005/0238989 A1 Oct. 27, 2005

(30) Foreign Application Priority Data

Apr. 26, 2004 (JP) ..... P2004-130308

(51) Int. Cl.
*G03G 5/047* (2006.01)

(52) U.S. Cl. ..... 430/133; 118/258; 118/232; 118/244; 118/262; 427/428.14; 427/428.15

(58) Field of Classification Search ..... 430/127, 430/133, 134; 427/428.01, 248.07, 428.14, 427/428.15; 118/232, 244, 258, 262
See application file for complete search history.

(56) References Cited

U.S. PATENT DOCUMENTS

| | | | | |
|---|---|---|---|---|
| 6,245,475 | B1 * | 6/2001 | Scharfe et al. | 430/127 |
| 7,393,415 | B2 * | 7/2008 | Obata et al. | 118/668 |
| 2002/0018857 | A1 * | 2/2002 | Bode et al. | 427/428 |
| 2004/0054095 | A1 * | 3/2004 | Allen et al. | 525/418 |
| 2005/0103262 | A1 * | 5/2005 | Bush et al. | 118/258 |

FOREIGN PATENT DOCUMENTS

| | | | |
|---|---|---|---|
| JP | 2-272567 | A | 11/1990 |
| JP | 3-12261 | A | 1/1991 |
| JP | 11-19554 | A | 1/1999 |
| JP | 11-216405 | A | 8/1999 |
| JP | 11-276958 | A | 10/1999 |
| JP | 11-343438 | A | 12/1999 |
| JP | 2000-84472 | A | 3/2000 |
| JP | 2000-325863 | A | 11/2000 |
| JP | 2004-29134 | A | 1/2004 |
| JP | 2004-31077 | A | 1/2004 |
| JP | 2005087971 | A * | 4/2005 |

OTHER PUBLICATIONS

U.S. Appl. No. 10/971,340, filed Oct. 22, 2004 entitled Apparatus and Method for Applying Coating Liquid to Cylindrical Substrate, and Electrophotographic Photoreceptor Produced by that Method and Electrophotographic Apparatus Provided with the Same.

* cited by examiner

*Primary Examiner*—Mark F Huff
*Assistant Examiner*—Rachel L Burney
(74) *Attorney, Agent, or Firm*—Nixon & Vanderhye P.C.

(57) ABSTRACT

A method for producing a high-quality and low-cost laminate type electrophotographic photoreceptor having a coating film of uniform thickness with high efficiency is provided. In the electrophotographic photoreceptor having a laminated structure composed at least of two layers: a charge generating layer containing a charge generating substance and a charge transporting layer containing a charge transporting substance, the charge generating layer is formed by applying a coating solution for forming the charge generating layer onto the conductive support by an ink-jet coating method, and the charge transporting layer is formed by applying a coating solution for forming the charge transporting layer onto the charge generating layer by a roll coating method.

10 Claims, 5 Drawing Sheets

METHOD AND APPARATUS FOR PRODUCING ELECTROPHOTOGRAPHIC PHOTORECEPTOR

BACKGROUND OF THE INVENTION

1. Field of the Invention

The present invention relates to a method and apparatus for producing an electrophotographic photoreceptor designed for use in an image forming apparatus such as a copying machine and a printer.

2. Description of the Related Art

An electrophotographic photoreceptor designed for use in an image forming apparatus such as a copying machine, a printer and a facsimile machine, is commonly fabricated by coating the outer peripheral surface of a hollow cylindrical substrate with organic photosensitive layers. In consequence of repeated developments directed toward providing higher-performance electrophotographic photoreceptors to meet the recent demand, most of the developed electrophotographic photoreceptors have come to comprise a photosensitive layer having a laminated structure formed by comprising or coating an intermediate layer, a charge generating layer, and a charge transporting layer in order. Further, though only in some electrophotographic photoreceptors, a protective layer for enhancing durability is added on the outermost layer of the laminated structure.

In the present specification, a layer composed of the intermediate layer, the charge generating layer, the charge transporting layer, and the protective layer will be collectively referred to as "photosensitive layer". Note that the intermediate layer and the protective layer are provided solely to achieve performance improvement, and are therefore not essential for the electrophotographic photoreceptor. Thus, a layer composed of the charge generating layer and the charge transporting layer, as well as a layer of the charge generating layer and the charge transporting layer that are integrated as a single layer, will also be referred to as a photosensitive layer. In some cases, part of the laminated structure including the charge generating layer and the charge transporting layer, as well as part of the layer including the charge generating layer and the charge transporting layer that are integrated as a single layer, will be exclusively referred to as "photoconductive layer".

The photosensitive layer to be provided in the electrophotographic photoreceptor is required to take the form of a thin film having a uniform thickness. In order to ensure high performance in the electrophotographic photoreceptor by applying a light coating of the photosensitive layer in uniform thickness, and also to achieve coating at lower cost, research and development have been under way to come up with innovative coating techniques.

As techniques for coating with the photosensitive layer the outer peripheral surface of a cylindrical substrate acting as an electrophotographic photoreceptor elementary tube, there have hitherto been known several coating methods such as spray coating method, dip coating method, and blade coating method. However, such conventional coating techniques pose problems, for example coating unevenness and poor productivity.

For example, according to the spray coating method, a coating operation is performed through the use of a spray nozzle for ejecting a coating solution in the form of a microscopic particle. In this case, while the resultant coating is satisfactory from outer appearance, in reality a coating layer obtained through one-time coating has a quite small thickness. Therefore, repeated coating operations are required to achieve a desired layer thickness. Moreover, when a large quantity of coating solution is applied at one time, the coating solution falls in drops, which results in formation of a coating layer having an uneven thickness. Furthermore, during the coating operation with a jet of coating solution, the volatile constituent present in the coating solution is easily volatilized. This causes an undesirable increase in the viscosity of the coating solution, in consequence whereof there results an orange-peel surface on the resultant coating layer (i.e. a phenomenon in which undulations such as found in an orange peel appear on the surface of the layer).

On the other hand, according to the dip coating method, a cylindrical substrate acting as an electrophotographic photoreceptor elementary tube is immersed in a coating solution, with its one end kept retained in position, while the axis of the cylinder is maintained in a vertical alignment with respect to the fluid level. Upon raising the sunken cylinder after a certain period of time, the surface of the cylindrical substrate is coated with a photosensitive layer. This method has been widely used for production of electrophotographic photoreceptors. However, in the case of adopting the dip coating method, the layer thickness (hereafter also referred to as "film thickness") of a coating is highly dependent on, for example the rate at which the cylindrical substrate is pulled out from the coating solution; the viscosity of the coating solution; and the rate at which the volatile constituent contained in the coating solution evaporates. These factors need to be strictly controlled accordingly. Moreover, since the cylindrical substrate is raised from the coating solution in a vertical direction, it follows that the coating solution drips down from the surface of the cylindrical substrate due to the influence of gravity. As a result, the applied coating film becomes thinner at the upper end of the cylindrical substrate relative to the lower end thereof, when viewed in the raising direction. Furthermore, a coating solution portion remaining at the lower end of the cylindrical substrate tends to dry out inadequately. Therefore, if the subsequent coating is applied before the existing coating layer dries out sufficiently, the two coating solutions will be mixed with each other, which may cause a so-called contamination.

In order to eliminate such unevenness of the film thickness, the raising rate needs to be controlled strictly. However, besides the difficulty in controlling the raising rate, there is a fundamental problem that a coating film having a uniform thickness cannot be obtained without lowering the rate at which the cylindrical substrate is raised after dipping has been performed. Another problem is that the coating is needlessly applied also to the interior and the end face of the cylindrical substrate. There will thus emerge a need for removing the unnecessary coating films formed in the aforementioned regions. In addition, since the cylindrical substrate is wholly immersed in the coating solution, the coating solution needs to be stored in a reservoir at all times in an amount large enough for the cylindrical substrate to be soaked throughout its length. That is, there is a need to constantly prepare the coating solution in a larger amount than is necessary for coating-film formation. This leads to an undesirable decrease in coating solution utilization efficiency. In an attempt to increase the coating solution utilization efficiency, instead of preparing a new coating solution every time a coating operation is performed, reuse of the existing coating solution has been brought into practice. In this case, a newly prepared coating solution is added only in a required amount in the used coating solution stored in the reservoir every time a coating operation is performed. However, the viscosity and characteristics of the coating solution vary with time, and also vary with the addition of the newly prepared coating solution because of a subtle difference between the two fluid materials. As a result, there will be a necessity to optimize the coating conditions every time a coating operation is performed, which leads to poor operation efficiency.

According to the blade coating method, a coating operation is performed as follows. At the outset, a blade is arranged in the proximity of the cylindrical substrate so as to face the cylindrical substrate. Then, the blade is supplied with a coating solution so as to apply the coating solution to the cylindrical substrate. After one turn of the cylindrical substrate, the blade is driven to retract. While this method yields high productivity, during the retraction of the blade, part of the coating film applied to the cylindrical substrate is upheaved due to the surface tension of the coating solution. This leads to unevenness in film thickness.

Aside from the coating methods described just above, there have been known a roll coating method and an ink-jet coating method. According to the roll coating method, onto a coating roll is formed a coating solution film whose thickness is controlled properly. Then, the cylindrical substrate is arranged in the proximity of or in abutment with the coating roll so as to face the coating roll. By rotating the cylindrical substrate and the coating roll respectively, it is possible to allow the coating roll to print-coat the coating solution onto the cylindrical substrate. On the other hand, according to the ink-jet coating method, a nozzle is arranged so as to face the cylindrical substrate. A coating operation is performed with a jet of ink droplets ejected from the nozzle.

The roll coating method is advantageous in its coating solution utilization efficiency, that is, it requires only a small quantity of base coating solution for production. However, the roll coating method has also drawbacks. When the coating roll and the cylindrical substrate are separated from each other after the coating operation, an excess of the coating solution is prone to adhere to the cylindrical substrate due to the surface tension of the coating solution, which is a so-called fluid-trailing phenomenon. Moreover, the resultant coating film is seamed due to the fluid-trailing phenomenon, in consequence whereof there results unevenness in film thickness. This leads to occurrence of image defects. Note that the seam that appears on the coating film refers to surface unevenness (uneven film thickness) resulting from adhesion of the excessive coating solution, which takes place in accompaniment with the separating motion between the coating roll and the cylindrical substrate.

In order to prevent occurrence of the seam, several related art techniques have been proposed to date. For example, according to Japanese Unexamined Patent Publication JP-A 3-12261 (1991), upon completion of one or more turns of the cylindrical substrate to bring the coating operation to an end, the cylindrical substrate is moved away from a coating supply roll, while the cylindrical substrate is driven to rotate continuously so as to bring about a leveling effect on the coating surface (to make the film thickness uniform). In the method disclosed in Japanese Unexamined Patent Publication JP-A 3-12261, however, there is a need to allow for the amount of a clot of coating solution to be leveled off so as to achieve highly accurate film-thickness control. Another problem is that the seam cannot be removed readily to perfection.

For example, according to Japanese Unexamined Patent Publication JP-A 11-216405 (1999), the seam is prevented from occurring by reducing the film thickness of a coating material put on the coating roll in accompaniment with the separating motion between the coating roll and the cylindrical substrate. Moreover, according to Japanese Unexamined Patent Publication JP-A 2000-325863 (2000), after a coating operation, the relationship between the film thickness of a coating material put on the coating roll and a gap left between the coating roll and the cylindrical substrate is defined. In conformity with the relationship, the amount of the coating material put on the coating roll is reduced, so that the coating material portion laid across the coating roll and the cylindrical substrate can be cut off. However, neither of the methods disclosed in Japanese Unexamined Patent Publication JP-A 11-216405 and Japanese Unexamined Patent Publication JP-A 2000-325863 succeeded in lessening the seam to the extent of preventing occurrence of image defects with perfection. Furthermore, in the case of adopting such methods, it is necessary to control the coating conditions strictly during the coating and separating operations. This makes it impossible to provide high productivity.

Moreover, for example, Japanese Unexamined Patent Publication JP-A 11-276958 (1999) proposes exercising control of the pace at which the coating roll and the cylindrical substrate are spaced apart after a coating operation. However, the technique disclosed in Japanese Unexamined Patent Publication JP-A 11-276958, alike to those disclosed in Japanese Unexamined Patent Publications JP-A 11-216405 and JP-A 2000-325863 described above, failed to lessen the seam to the extent of preventing occurrence of image defects with perfection.

Further, according to Japanese Unexamined Patent Publication JP-A 2000-84472 (2000), a rib is created on the coating film by causing a difference in circumferential velocity between the coating roll and the cylindrical substrate. In this state, the coating roll and the cylindrical substrate are separated from each other. However, the method disclosed in Japanese Unexamined Patent Publication JP-A 2000-84472 has drawbacks, too. In creating a rib on the coating film, if a solvent having a low boiling point is used, it will be impossible to secure a sufficient leveling time required to remove the rib so that the film thickness can be made uniform, in consequence whereof there results undulations on the coating film. By way of contrast, if a solvent having a high boiling point is used, while the leveling time can be secured adequately, much time needs to be spent in a drying operation. As a result, the productivity is significantly deteriorated. Furthermore, formation of a desired rib cannot be achieved without determining various coating conditions strictly including a roll diameter; circumferential velocity; a gap; the viscosity of a coating material; and surface tension. Besides the difficulty in determining such coating conditions, there is a problem that the composition of a coating solution and apparatus configuration are limited in their range of adjustment. In particular, considering the small film thicknesses of the charge generating layer and the intermediate layer, it could be extremely difficult to determine conditions to be fulfilled for forming a desired rib. Granted that a rib is formed satisfactorily, since it will dry out in a short period of time, it follows that a sufficient leveling time cannot be secured. This makes it difficult to obtain a layer having a uniform thickness.

On the other hand, the ink-jet method for coating is through the use of a minute nozzle. A jet of coating solution droplets ejected from the nozzle is applied to a target object under coating. There have been known a few types of nozzle head structures, namely, a few ways of ejecting a jet of coating solution, as exemplified by the piezoelectric method and the bubble jet (registered trademark) method/thermal method. According to the former, a coating solution is forced to jet out under the vibration pressure of a piezo element. According to the latter, electric power is applied to a heater to cause a temperature rise, thereby creating bubbles in a coating solution. The coating solution is forced to jet out under the expansion pressure of the bubbles. The ink-jet coating method possesses several advantages. For example, a jet of coating solution droplets is allowed to fly rectilinearly with high accuracy. Moreover, since the ejecting actions of a plurality of nozzles can be controlled individually, it follows that no masking process is required; wherefore the coating efficiency can be increased significantly. Further, replacement of the coating solution can be made simply by changing an ink storage tank, and the coating solution can be utilized to the fullest. This makes it possible to provide extremely high productivity.

As a related art practice for forming a coating film on the surface of a columnar or cylindrical target object under coating by the ink-jet coating method, Japanese Unexamined Patent Publication JP-A 2-272567 (1990) proposes one that performs a coating operation by driving a to-be-coated object to rotate in a horizontally-retained state while moving a discharge nozzle along the surface of the to-be-coated object in a direction of the rotation axis of the to-be-coated object. The example disclosed in Japanese Unexamined Patent Publication JP-A 2-272567 employs tetrahydrofuran alone as a solvent for a coating solution. However, since the boiling point of tetrahydrofuran is unduly low and the solvent is therefore volatilized soon, its use poses a risk that the coating solution dries out at the discharge portion of the discharge nozzle, whereby clogging is induced in the nozzle. In addition to that, the aimed leveling effect is not adequately exerted on the coating.

As another related art practice related to the ink-jet coating, Japanese Unexamined Patent Publication JP-A 11-19554 (1999) proposes one that performs coating on a to-be-coated object with use of coating solution droplets which are forced to fly continuously in streak form from a plurality of minute nozzles under pressure. In the method disclosed in Japanese Unexamined Patent Publication JP-A 11-19554, however, the nozzles cannot be controlled individually. Furthermore, since a pump for applying pressure and the discharge nozzle are connected to each other by a tube, there arises a time lag between pressurization and discharge. Thus, in contrast to the other ink-jet coating method that allows individual nozzle control, this method is disadvantageous in accuracy and response.

Here, the to-be-coated object is assumed to be an electrophotographic photoreceptor. In a case where an approximately 20 to 40 μm-thick charge transporting layer is formed by the ink-jet coating method, since coating solution droplets are ejected from the nozzle which is as small as a few tens of micrometers (μm), a plurality of coating layers need to be formed by repeated coating operations to attain the desired thickness. This slows down the coating process, thereby deteriorating the productivity significantly. Moreover, because of the difficulty in applying the coating solution in uniform thickness, the nozzle tends to suffer from clogging due to drying. This makes it difficult to allow the coating solution to be discharged with stability for a longer period of time.

Meanwhile, although the ink-jet coating method is suitable for forming a charge generating layer having a small thickness, considering the fact that a layer to be obtained is a thin film, it will be difficult to control the physical properties of the coating solution used as a material to form the thin film. In general, in a high-viscosity coating solution, while uniformity of liquid composition can be ensured readily because of its resistance to pigment precipitation, the dischargeability is poor. By way of contrast, in a low-viscosity coating solution, while a satisfactory dischargeability can be ensured, pigments are prone to precipitation and coagulation that will eventually cause nozzle clogging.

Moreover, in general, a charge generating layer and a charge transporting layer are separately formed by coating in different coating devices that are spaced apart. To achieve this, not only a conveyance system for conveying a to-be-coated object to each of the coating devices, but also a carrier for transferring the to-be-coated object to the conveyance system need to be prepared for use. This gives rise to a problem of an undesirable increase in equipment investment cost.

Hence, in the production of electrophotographic photoreceptors, highly efficient production method and apparatus have been sought after that enable both a charge generating layer and a charge transporting layer to be formed in a single, common device and require less coating solution than ever.

SUMMARY OF THE INVENTION

An object of the invention is to provide a method and an apparatus capable of producing a high-quality and low-cost laminate type electrophotographic photoreceptor having a coating film of uniform thickness with high efficiency.

The invention provides a method for producing an electrophotographic photoreceptor that is obtained by comprising or coating, on a cylindrical substrate or an intermediate layer formed on the cylindrical substrate, at least two layers: a charge generating layer containing a charge generating substance and a charge transporting layer containing a charge transporting substance, comprising the steps of:

forming the charge generating layer by applying a coating solution for forming the charge generating layer onto the cylindrical substrate or an intermediate layer formed on the cylindrical substrate by an ink-jet coating method; and forming the charge transporting layer by applying a coating solution for forming the charge transporting layer onto the charge generating layer by a roll coating method.

In the invention, it is preferable that the coating solution for forming the charge generating layer is adjusted to have a viscosity of 10 mPa·s or below.

In the invention, it is preferable that the coating solution for forming the charge generating layer contains a solvent having a boiling point of 120° C. or more in a range from 5 to 40% by weight.

In the invention, it is preferable that the solvent having a high boiling point is composed of one or two or more of materials selected from the group consisting of cyclohexanone, pyrrolidone, and n-methyl pyrrolidone.

In the invention, it is preferable that, in the ink-jet coating method, ejection of the coating solution for forming the charge generating layer is performed by a piezoelectric method.

The invention provides an apparatus for producing an electrophotographic photoreceptor that is obtained by comprising or coating, on a cylindrical substrate or an intermediate layer formed on the cylindrical substrate, at least two layers: a charge generating layer containing a charge generating substance and a charge transporting layer containing a charge transporting substance, comprising:

ink-jet type coating means for forming the charge generating layer by discharging a coating solution for forming the charge generating layer onto the cylindrical substrate or an intermediate layer formed on the cylindrical substrate;

roll-coat type coating means for forming the charge transporting layer on the charge generating layer; and control means for controlling operations of the ink-jet type coating means and the roll-coat type coating means, wherein the roll-coat type coating means includes:

a coating roll for applying a coating solution for forming the charge transporting layer onto the charge generating layer;

coating solution supply means for supplying the coating solution for forming the charge transporting layer to the coating roll;

substrate supporting means for supporting the cylindrical substrate onto which the coating solution for forming the charge transporting layer is transferred;

first driving means for rotatably driving the cylindrical substrate supported by the substrate supporting means; and second driving means for rotatably driving the coating roll.

In the invention, it is preferable that the ink-jet type coating means is fitted to the substrate supporting means so as to be located above the cylindrical substrate.

Further, in the invention, it is preferable that the apparatus for producing an electrophotographic photoreceptor further comprises approaching/separating means allowing the cylindrical substrate to move approachably and separably with respect to the coating roll.

Further, in the invention, it is preferable that the apparatus for producing an electrophotographic photoreceptor further comprises film thickness adjustment means having a cylindrical member arranged so as to face the coating roll and an adjustment member for adjusting a gap between the cylindrical member and the coating roll.

According to the invention, in the electrophotographic photoreceptor having a laminated structure composed of the charge generating layer and the charge transporting layer, the charge generating layer is formed by the ink-jet coating method, and the charge transporting layer is formed on the charge generating layer by the roll coating method. In this way, a high-quality electrophotographic photoreceptor having a coating film of uniform thickness can be produced with high efficiency at lower cost.

Moreover, according to the invention, the coating solution for use in forming the charge generating layer is adjusted to have a viscosity of 10 m Pa·s or below. By setting the viscosity of the coating solution for use in forming the charge generating layer at an appropriate value in this way, it is possible to maintain the discharge stability at a high level, and thereby prevent occurrence of problems such as significant changes of the amount of coating solution droplets, a failure of proper discharge, and nozzle clogging. Accordingly, the charge generating layer having a uniform thickness can be produced with stability.

Moreover, according to the invention, the coating solution for forming the charge generating layer contains a solvent having a boiling point as high as 120° C. or above in a range from 5 to 40% by weight. The solvent having a high boiling point is preferably composed of one or two or more of materials selected from the group consisting of cyclohexanone, pyrrolidone, and n-methyl pyrrolidone. By admixing the solvent having a high boiling point in the coating solution for forming the charge generating layer in an appropriate amount, it is possible to avoid undesirable dryness of the coating solution around the nozzle, and thereby prevent occurrence of nozzle clogging; wherefore stable dischargeability can be maintained. Besides, as the after-coating leveling effect is enhanced, a uniform coating film of the charge generating layer can be attained.

Further, according to the invention, in the ink-jet coating method, ejection of the coating solution for forming the charge generating layer is performed under a piezoelectric method. Thus, neither kogation nor ignition of combustibles such as a flammable solvent takes place.

Further, according to the invention, the apparatus for producing an electrophotographic photoreceptor is provided with the ink-jet type coating means for forming the charge generating layer and the roll-coat type coating means that includes the coating roll for forming the charge transporting layer. In the production apparatus thus designed, both the charge generating layer and the charge transporting layer can be formed in a single, common apparatus, and therefore no plural apparatuses are required. This helps reduce the equipment investment cost. Moreover, in the production apparatus, a coating operation is performed with use of a little amount of coating solution, whereby making it possible to produce small batches of a variety of products with high efficiency. The reduction of the coating solution consumption leads to minimization of liquid wastes produced throughout the manufacturing process, and leads to minimization of environmental loads, as well.

Still further, according to the invention, the ink-jet type coating means is arranged above the cylindrical substrate. In this structure, abutment and separating motions can be imparted to the cylindrical substrate smoothly during the formation of the charge transporting layer.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
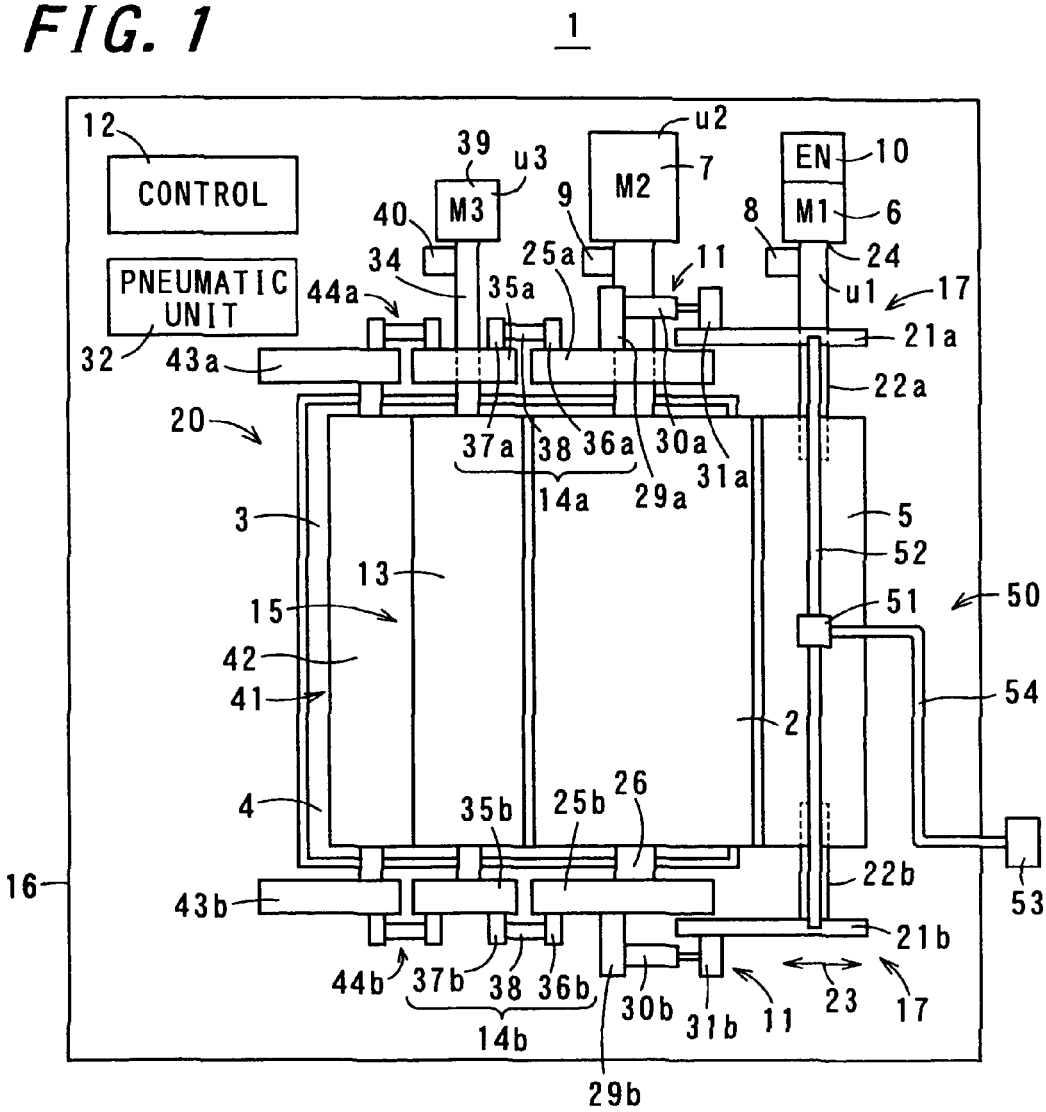
FIG. 1 is a plan view showing a simplified configuration of a production apparatus designed for use in the manufacture of laminate type electrophotographic photoreceptors according to a first embodiment of the invention.

Now referring to the drawings, preferred embodiments of the invention are described below.

The electrophotographic-photoreceptor production method embodying the invention aims at producing a laminate type electrophotographic photoreceptor constituted by stacking, on a cylindrical substrate or an intermediate layer formed on the cylindrical substrate, at least two layers: a charge generating layer containing a charge generating substance and a charge transporting layer containing a charge transporting substance. According to the electrophotographic-photoreceptor production method of the invention, the charge generating layer is obtained by applying a coating solution prepared to form the charge generating layer to the cylindrical substrate or the intermediate layer formed on the cylindrical substrate by an ink-jet coating method, whereas the charge transporting layer is obtained by applying a coating solution prepared to form the charge transporting layer to the charge generating layer by roll coating method.

The charge generating layer normally has a film thickness as small as 1 μm or below and can therefore be obtained through a fewer number of recoating. Even if a low-solid-content solvent having a viscosity as low as a few m Pa·s is used to form the charge generating layer, since the solvent exhibits satisfactory dispersibility, it follow that the ink-jet coating method is suitable for use.

On the other hand, the charge transporting layer normally has a film thickness as large as 20 μm or above. In a case where such a thick charge transporting layer is formed by the ink-jet coating method, a solvent with low solid content and low viscosity needs to be prepared for use to ensure dischargeability. In this case, an unduly large number of recoating is required, which prolongs the time for the coating process greatly. Furthermore, in order to perform recoating with use of a low-solid-content coating solution, a solvent having high volatility is required to ensure dryness. This gives rise to a problem such as nozzle clogging resulting from drying-induced fluid solidification occurring near the discharge nozzle, or a failure of exerting an adequate leveling effect on the coating solution deposited onto the conductive substrate. Hence, the charge transporting layer should preferably be formed by the roll coating method that is free from such problems.

The intermediate layer is so shaped as to have a small film thickness of approximately 1 μm with use of a coating solution having a viscosity as low as a few m Pa·s. In a case where such an intermediate layer is formed by the ink-jet coating method, because of the high specific gravity and high propensity for precipitation of the pigments in the coating solution in use, for example titanium oxide, there is a high risk that the pigments precipitate and coagulate around the nozzle that will eventually cause a failure of proper discharge. Furthermore, being quite solid, titanium oxide hastens wear and tear of the nozzle, which leads to poor durability. Hence, the intermediate layer should preferably be formed by the dip coating method or the roll coating method.

Figure 2:
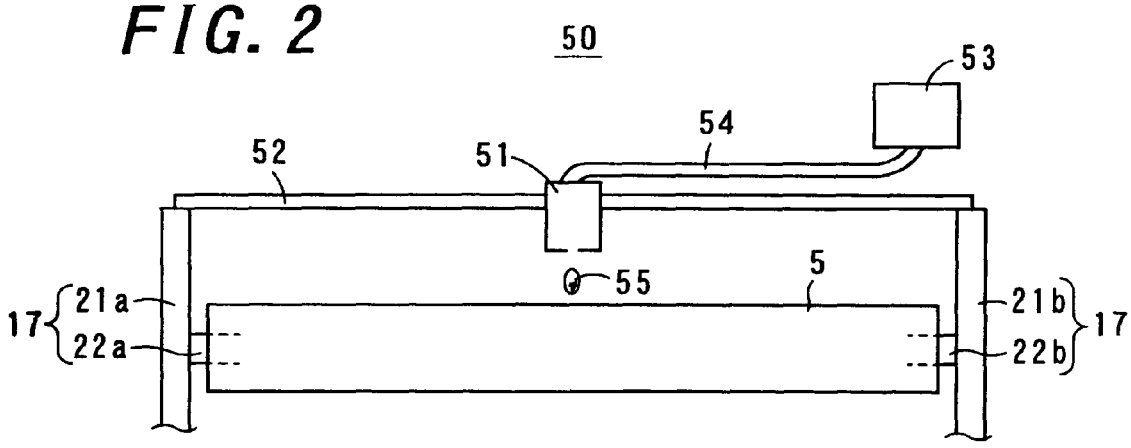
FIG. 2 is a view showing the configuration of ink-jet type coating means employed in the electrophotographic photoreceptor production apparatus shown in FIG. 1.

FIG. 1 is a plan view showing a simplified configuration of a production apparatus 1 according to a first embodiment of the invention designed for use in the manufacture of laminate type electrophotographic photoreceptors. FIG. 2 is a view showing the configuration of ink-jet type coating means 50 employed in the electrophotographic photoreceptor production apparatus 1 shown in FIG. 1.

The electrophotographic photoreceptor production apparatus 1 (hereafter, referred to simply as "production apparatus 1") is composed of the ink-jet type coating means 50, roll-coat type coating means 20, and control means 12. The ink-jet type coating means 50 serves to form a charge generating layer by discharging a coating solution prepared to form the charge generating layer onto a substantially cylindrical substrate or an intermediate layer formed on the cylindrical substrate. The roll-coat type coating means 20 serves to form a charge transporting layer on the charge generating layer with a roll-coating technique. The control means 12 serves to control the operations of the ink-jet type coating means 50 and the roll-coat type coating means 20.

The roll-coat type coating means 20 is composed of a coating roll 2 (also called "applicator roll"), coating solution supply means 4; substrate supporting means 17, first driving means 6 and second driving means 7. In the embodiment, the roll-coat type coating means 20 is further composed of first circumferential velocity detecting means 8, second circumferential velocity detecting means 9, rotation count detecting means 10, approaching/separating means 11 and film thickness adjustment means 15. The coating roll 2 transfers a coating solution 3 for forming the charge transporting layer onto a cylindrical substrate 5. The coating solution supply means 4 supplies the coating solution 3 for forming the charge transporting layer to the coating roll 2. The substrate supporting means 17 supports the cylindrical substrates. The first driving means 6 drives the cylindrical substrate 5 to rotate. The second driving means 7 drives the coating roll 2 to rotate. The first circumferential velocity detecting means 8 detects a circumferential velocity at which the cylindrical substrate 5 rotates. The second circumferential velocity detecting means 9 detects a circumferential velocity at which the coating roll 2 rotates. The rotation count detecting means 10 detects the count of rotation of the cylindrical substrate 5. The approaching/separating means 11 allows the cylindrical substrate 5 to move approachably and separably with respect to the coating roll 2. The film thickness adjustment means 15 includes a cylindrical member 13 arranged so as to face the coating roll 2 and an adjustment members 14*a*, 14*b* for adjusting a gap between the cylindrical member 13 and the coating roll 2. The control means 12 controls, in response to the detection output fed from the rotation count detecting means 10, the operation of the approaching/separating means 11 in such a way that the cylindrical substrate 5 is moved away from the coating roll 2, and also controls the operations of the first and second driving means 6 and 7 in such a way that the cylindrical substrate 5 is rotated at higher circumferential velocity than the coating roll 2, and vice versa. All of the aforementioned constituent components are disposed on a platform 16.

On the platform 16 are disposed a pair of first chocks 21*a* and 21*b*. The first chock 21*a*, 21*b* is provided with a non-illustrated bearing for rotatably supporting a pair of axial rod members 22*a* and 22*b*, respectively. The cylindrical substrate 5 is detachably attached to the axial rod member 22*a*, 22*b* supported through the bearing by the first chock 21*a*, 21*b*. Thus, the first chock 21*a*, 21*b* and the axial rod member 22*a*, 22*b* constitute the substrate supporting means 17 described above. The first chock 21*a*, 21*b* is placed along a non-illustrated track path on the platform 16 so as to be guidedly moved in a direction 23 indicated by arrows that is perpendicular to the axis of the cylindrical substrate 5.

One axial rod member 22*a* is, at its end 24 opposite to the other end to which the cylindrical substrate 5 is fitted, coupled to the output shaft of a motor acting as the first driving means 6. In this way, the axial rod member 22*a* is driven to rotate under a driving force exerted by the first driving means 6. The cylindrical substrate 5 is driven to rotate by the first driving means 6 while being attached to the axial rod member 22*a*, 22*b*. The output shaft of the first driving means 6 is, at its one side opposite to the other side to which the axial rod member 22*a* is coupled, fitted to an encoder acting as the rotation count detecting means 10. The rotation count detecting means 10 serves to detect not only the count of rotation of the first driving means 6 but also the count of rotation of the cylindrical substrate 5. Also fitted to the axial rod member 22*a* is a rotational speed sensor acting as the first circumferential velocity detecting means 8. The first circumferential velocity detecting means 8 serves to detect not only the rotational speed of the first driving means 6 but also the circumferential velocity of the cylindrical substrate 5.

The coating roll 2 is arranged so as to face the cylindrical substrate 5 fitted to the axial rod member 22*a*, 22*b*, with its axis maintained in parallel with the axis of the cylindrical substrate 5. The coating roll 2 is rotatably supported, at its shaft rod 26, by a non-illustrated bearing mounted in a pair of second chocks 25*a* and 25*b* installed securely on the platform 16. One end of the shaft rod 26 of the coating roll 2 is coupled to the output shaft of a motor acting as the second driving means 7. In this way, the coating roll 2 is driven to rotate under a driving force exerted by the second driving means 7. Also fitted to the shaft rod 26 of the coating roll 2 is a rotational speed sensor acting as the second circumferential velocity detecting means 9. The second circumferential velocity detecting means 9 serves to detect not only the rotational speed of the second driving means 7 but also the circumferential velocity of the coating roll 2.

The second chocks 25*a* and 25*b* are provided with supporting members 29*a* and 29*b*, respectively, that are so disposed as to rise outwardly in a direction parallel to the surface of the platform 16. The supporting members 29*a* and 29*b* are fitted with air cylinders 30*a* and 30*b*, respectively, that are so disposed as to extend toward the first chocks 21*a* and 21*b*, respectively. The air cylinders 30*a* and 30*b* are, at the front ends of their rods, attached to first projections 31*a* and 31*b*, respectively. The first projections 31*a* and 31*b* are formed in the first chocks 21*a* and 21*b*, respectively, so as to rise outwardly in a direction parallel to the surface of the platform 16. The air cylinders 30*a* and 30*b* are each connected to a pneumatic unit 32 through non-illustrated piping. By exploiting air supplied from the pneumatic unit 32, the air cylinder 30*a*, 30*b* moves the rod advanceably and retractably in the arrow-indicated direction 23. The advancing and retracting movements of the rod of the air cylinder 30*a*, 30*b* allow the first chock 21*a*, 21*b* placed on the track path to move close to or away from the fastened second chock 25*a*, 25*b* in the arrow-indicated direction 23, that is; allow the cylindrical substrate 5 supported by the first chock 21*a*, 21*b* to move close to or away from the coating roll 2 supported by the second chock 25*a*, 25*b*. The air cylinder 30*a*, 30*b*; the piping; and the pneumatic unit 32 constitute the approaching/separating means 11.

In this embodiment, the coating solution supply means 4 is constituted by a pan for storing the coating solution 3 for forming the charge transporting layer in the interior space thereof. The coating solution supply means 4 is arranged on the platform 16 in such a way that the liquid level of the coating solution 3 for forming the charge transporting layer stored in the pan makes contact with at least part of the outer peripheral surface of the coating roll 2. In this way, the coating roll 2 in a state of rotation has its outer peripheral surface stuck to the coating solution 3 for forming the charge transporting layer stored in the pan, and will thus be ready for coating operations.

The production apparatus 1 of this embodiment further includes the film thickness adjustment means 15 for adjusting the thickness of the coating solution 3 membrane for forming the charge transporting layer that is supplied to the coating roll 2 in the above-described manner. As the cylindrical member 13 to be mounted in the film thickness adjustment means 15, a metalling roll 13 is employed in this embodiment. The metalling roll 13 is rotatably supported, at its shaft rod 34, by a pair of third chocks 35*a* and 35*b* each having a non-illustrated bearing. The third chock 35*a*, 35*b* is, alike to the first chock 21*a*, 21*b*, placed along a non-illustrated track path on the platform 16 so as to be guidedly moved in the arrow-indicated direction 23.

The adjustment members 14*a*, 14*b* are composed of a second projection 36*a*, 36*b*; a third projection 37*a*, 37*b*; and an external thread member 38. The second projection 36*a*, 36*b* is, alike to the first projection 31*a*, 31*b* formed in the first chock 21*a*, 21*b*, formed in the second chock 25*a*, 25*b*. The third projection 37*a*, 37*b* is formed in the third chock 35*a*, 35*b* so as to face with the second projection 36*a*, 36*b*. The external thread member 38 is interposed between the second projection 36*a*, 36*b* and the third projection 37*a*, 37*b*. For example, the external thread member 38 has its head portion rotatably attached to the second projection 36*a*, 36*b*, and has its screw-carved portion engaged in an internal thread formed in the third projection 37*a*, 37*b*. Upon rotation of the head portion of the external thread member 38, the rotary motion of the external thread member 38 is converted into a rectilinear displacement of the third chock 35*a*, 35*b* having the third projection 37*a*, 37*b* which is threadedly engaged to the external thread member 38, thereby allowing the third chock 35*a*, 35*b* to move in the arrow-indicated direction 23. In this way, the third chock 35*a*, 35*b* is moved close to or away from the second chock 25*a*, 25*b*, that is; the metalling roll 13 is moved close to or away from the coating roll 2. This makes it possible to adjust the thickness of the coating solution 3 membrane for forming the charge transporting layer that is defined by the gap left between the coating roll 2 and the metalling roll 13.

Note that the adjustment members 14*a*, 14*b* are not limited to the configuration using the external thread member 38, but may be of another configuration. For example, between the second chock 25*a*, 25*b* and the third chock 35*a*, 35*b* is interposed an air cylinder or a hydraulic cylinder. By actuating the cylinder, adjustment is made to the gap between the coating roll 2 and the metalling roll 13.

One end of the shaft rod 34 of the metalling roll 13 is coupled to the output shaft of a motor acting as third driving means 39. Thereby, the metalling roll 13 is driven to rotate under a driving force exerted by the third driving means 39. Also fitted to the shaft rod 34 of the metalling roll 13 is a rotational speed sensor acting as third circumferential velocity detecting means 40. The third circumferential velocity detecting means 40 serves to detect not only the rotational speed of the third driving means 39 but also the circumferential velocity of the metalling roll 13.

The coating solution 3 for forming the charge transporting layer deposited on the outer peripheral surface of the coating roll 2 passes through the gap between the coating roll 2 and the metalling roll 13, during which the thickness of the coating solution 3 membrane for forming the charge transporting layer is adjusted in accordance with the size of the gap. After undergoing the film thickness adjustment, the coating solution 3 for forming the charge transporting layer is transferred from the coating roll 2 to the cylindrical substrate 5. More specifically, the thickness adjustment (thickness reduction, in this case) for the coating solution 3 membrane for forming the charge transporting layer may be achieved also by narrowing the gap between the coating roll 2 and the metalling roll 13 while rotating the two rolls in the same direction, or by increasing the circumferential velocity of the metalling roll 13. Note that the metalling roll 13 can be designed with flexibility. For example, it may be 2 or more in number, or may be driven to rotate either in the same direction or in the reverse direction relative to the adjacent roll, or may be used for the film thickness adjustment in a stationary (i.e., unrotated) state.

In the roll-coat type coating means 20 employed in the production apparatus 1 as shown in FIG. 1, in general, a thickness L of a dried coating film is defined by the following formula (1). On the basis of the formula (1) the coating thickness can be controlled.

$$L=K\alpha\eta g\cdot\sqrt{(R_m)}\cdot\sqrt{(R_t^3)}/R\gamma \quad (1)$$

wherein

K represents a coefficient (coefficient specific to a roll diameter);

$\alpha$ represents the solid content concentration of a coating solution (vol %);

$\gamma$ represents the surface tension of the coating solution;

$\eta$ represents a viscosity associated with a shear rate set for a coating operation;

g represents the dimension of the gap between the coating roll and the metalling roll;

$R_m$ represents the circumferential velocity of the metalling roll;

$R_t$ represents the circumferential velocity of the coating roll; and

R represents the circumferential velocity of the cylindrical substrate.

The production apparatus 1 is additionally provided with cleaning means 41 for removing the coating solution 3 for forming the charge transporting layer. By the action of the cleaning means 41, the coating solution 3 for forming the charge transporting layer deposited on the surface of the metalling roll 13 is scraped off and is then collected in the pan acting as the coating solution supply means 4. The cleaning means 41 is composed of a cleaning blade 42; fourth chocks 43*a* and 43*b* for supporting the cleaning blade 42; and the other adjustment members 44*a* and 44*b*.

The fourth chock 43*a*, 43*b* is, alike to the first chock 21*a*, 21*b* described previously, mounted on the platform 16 so as to be movable in the arrow-indicated direction 23. The cleaning blade 42 is formed of a platy member, the longitudinal direction of which is aligned with the axial direction of the metalling roll 13. The coating solution 3 for forming the charge transporting layer deposited on the surface of the metalling roll 13 is scraped off by the transverse end of the cleaning blade 42. The cleaning blade 42 is angularly displaceably supported by the supporting section of the fourth chock 43*a*, 43*b*. By varying the angle at which the cleaning blade 42 faces transversely with the metalling roll 13, it is possible to adjust the size of the gap between the cleaning blade 42 and the metalling roll 13, and thereby control the amount of the coating solution 3 for forming the charge transporting layer to be scraped off. Alternatively, by adjusting the other adjustment member 44*a*, 44*b*, it is possible to change the distance between the third chock 35*a*, 35*b* and the fourth chock 43*a*, 43*b*, namely, the size of the gap left between the metalling roll 13 and the cleaning blade 42, and thereby control the amount of the coating solution 3 for forming the charge transporting layer to be scraped off. In another alternative, through the combined use of the angular displacement of the cleaning blade 42 and the adjustment to be made to the other adjustment member 44*a*, 44*b* described just above, it is also possible to control the amount of the to-be-scraped coating solution 3. Note that the other adjustment member 44*a*, 44*b* is constituted basically in the same manner as the previously-described adjustment member 14*a*, 14*b*, and therefore overlapping explanations will be omitted.

Next, a description will be given below as to the ink-jet type coating means 50 that constitute, together with the roll-coat type coating means 20, the principal part of the production apparatus 1. The ink-jet type coating means 50 is fitted to the substrate supporting means 17 so as to be located above the cylindrical substrate 5. The ink-jet type coating means 50 is composed of a coating section 51 provided with a discharge nozzle; a guide rail portion 52 to which the coating section 51 is movably attached; a charge-generating-layer coating solution supply section 53 for supplying a coating solution for forming the charge generating layer to the coating section 51; and a conveyance tube 54 connected to the coating section 51 and the charge-generating-layer coating solution supply section 53, for constituting a duct through which the coating solution for forming the charge generating layer is conveyed.

The charge-generating-layer coating solution supply section 53 is provided with a storage reservoir for storing therein the coating solution for forming the charge generating layer. The coating solution for forming the charge generating layer, which is supplied from the charge-generating-layer coating solution supply section 53 through the conveyance tube 54, is discharged from the coating section 51, in the form of a fluid droplet 55, toward the cylindrical substrate 5. In the piezoelectric method, the discharge nozzle mounted in the coating section 51 for discharging the fluid droplets 55 acts to eject the coating solution for forming the charge generating layer contained therein as the fluid droplets 55 under a mechanical pressure. The piezoelectric method is implemented by exploiting distortion resulting from application of a voltage to a piezoelectric element, for example.

Aside from the piezoelectric method, there has been known the thermal system as a method for ejecting fluid droplets adopted in the ink-jet coating method. According to the thermal system, heat is locally applied to a coating solution by a heating element to create bubbles in the coating solution. However, in this case, there is a possibility that a discharge operation ends in failure due to so-called kogation. Kogation is a phenomenon in which substances resulting from thermal decomposition of the coloring components present in the coating solution, trace amounts of inorganic impurities contained in the coating solution, agglomerated substances, etc., are adhesively accumulated on the heat source and the heat source is therefore no longer capable of heating the coating solution satisfactorily. As a result, the coating solution cannot be continuously discharged with stability. By way of contrast, in the piezoelectric method, the coating solution can be discharged continuously with stability without suffering from kogation. It will thus be seen that the piezoelectric method is suitable for forming a thin-film layer in particular. Moreover, inmost cases, a flammable solvent is used to produce an electrophotographic photoreceptor. The piezoelectric method produces little heat and is therefore more desirable in terms of security.

For example, the guide rail portion 52 is made of a rod-like metal member. The guide rail portion 52 is detachably attached to the substrate supporting means 17 in parallel with the axis of the cylindrical substrate 5. Thus, the coating section 51 attached to the guide rail portion 52 is guided by the guide rail portion 52 so as to be movable in the axial direction of the cylindrical substrate 5, with a predetermined interval secured between the coating section 51 and the cylindrical substrate 5. For example, the parallel movement of the coating section 51 is accomplished by forming the guide rail portion 52 in a rack, by disposing a motor in the coating section 51, and by disposing a pinion in the output shaft of the motor.

The coating solution for forming the charge generating layer is used to form the charge generating layer on the cylindrical substrate 5 by the ink-jet type coating means 50. It contains charge generating substances, adhesive resin, and a solvent. Specifically, a solvent having a boiling point as high as 120° C. or above is contained therein in the range of 5 to 40% by weight. The high-boiling-point solvent contained in the coating solution for forming the charge generating layer should preferably be prepared with use of one, or two or more selected from the group consisting of cyclohexanone; pyrrolidone; and n-methylpyrrolidone. Moreover, the coating solution for forming the charge generating layer is adjusted to have a viscosity of 10 mPa·s or below.

If the content of the high-boiling-point solvent contained in the coating solution for forming the charge generating layer is less than 5% by weight, both the dischargeability of the nozzle and the after-coating leveling effect will be deteriorated. By way of contrast, if the content exceeds 40% by weight, the after-coating dryness will be decreased so sharply that the coating solution falls in drops, which results in unevenness in film thickness. Hence, the content of the high-boiling-point solvent is adjusted to fall within the range of 5 to 40% by weight.

Moreover, if the viscosity of the coating solution for forming the charge generating layer exceeds 10 mPa·s, liquid droplets ejected from the nozzle will be so small that the discharge stability is deteriorated, whereby making it difficult to obtain a coating film of uniform thickness. Note that, although there is no particular limitation to a lower limit of the viscosity value, unduly low viscosity leads to storage instability of the coating solution in the nozzle (i.e., leakage). Hence, the viscosity of the coating solution for forming the charge generating layer should preferably be set at 1 mPa·s or above. For example, measurement of the viscosity thereof can be carried out by using the rotational E-type viscometer manufactured by Toki Sangyo Co., Ltd.

Figure 3:
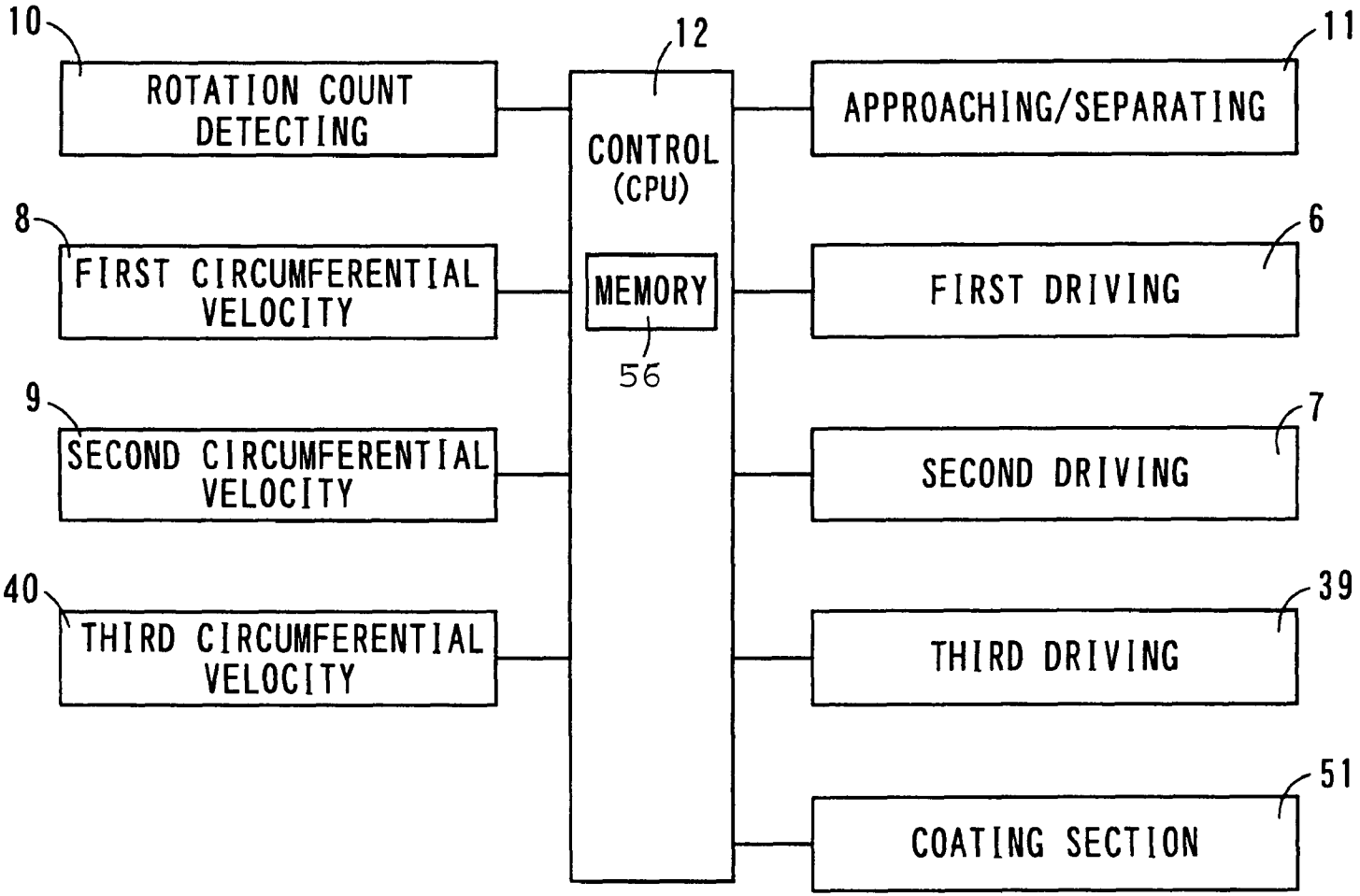
FIG. 3 is a block diagram schematically showing electrical connection in the principal configuration of the production apparatus.

FIG. 3 is a block diagram schematically showing electrical connection in the principal configuration of the production apparatus 1. The control means 12 is constituted by a processing circuit having a central processing unit (CPU for short). Also provided in the control means 12 is a memory 56 that stores therein, as table data, programs for controlling the operation of the production apparatus 1 as a whole, and coating conditions which are pre-determined in consideration of the types and characteristics of an electrophotographic photoreceptor to be produced by coating operations and a coating solution in use, that is; coating conditions to be fulfilled by the ink-jet type coating means 50 as well as those to be fulfilled by the roll-coat type coating means 20.

The coating conditions to be fulfilled by the ink-jet type coating means 50 include: a circumferential velocity of the cylindrical substrate 5; a movement rate at which the coating section 51 is moved through the guide of the guide rail portion 52; an amount of the fluid droplets 55 to be discharged from the coating section 51 (discharge rate); and count of rotation of the cylindrical substrate 5. These conditions correspond to a state where the cylindrical substrate 5 is being coated with the coating solution for forming the charge generating layer.

The coating conditions to be fulfilled by the roll-coat type coating means 20 include: a circumferential velocity u1 of the cylindrical substrate 5 rotating under a driving force of the first driving means 6; a circumferential velocity u2 of the coating roll 2 rotating under a driving force of the second driving means 7; a circumferential velocity u3 of the metalling roll 13 rotating under a driving force of the third driving means 39; a circumferential velocity ratio r (=u1/u2) between the cylindrical substrate 5 and the coating roll 2; and count of rotation of the cylindrical substrate 5 for determining a timing with which the cylindrical substrate 5 and the coating roll 2 are separated from each other after the starting of a coating operation. These conditions correspond to a state where the coating roll 2 is performing coating on the cylindrical substrate 5. The coating conditions further include: a circumferential velocity V1 of the cylindrical substrate 5; a circumferential velocity V2 of the coating roll 2; a circumferential velocity ratio R (=V1/V2) between the cylindrical substrate 5 and the coating roll 2; and separation speed of the approaching/separating means 11. These conditions correspond to a state where the cylindrical substrate 5 and the coating roll 2 are being separated from each other.

The rotation count detecting means 10, the first circumferential velocity detecting means 8, the second circumferential velocity detecting means 9, and the third circumferential velocity detecting means 40 are each connected to the control means 12, so that their detection outputs: the count of rotation of the cylindrical substrate 5 numbered after the starting of a coating operation; the circumferential velocity of the cylindrical substrate 5; the circumferential velocity of the coating roll 2; and the circumferential velocity of the metalling roll 13 can be inputted individually. Also connected to the control means 12 are the approaching/separating means 11, the first driving means 6, the second driving means 7, the third driving means 39, and the coating section 51. In response to the detection outputs fed from the rotation count detecting means 10, the first circumferential velocity detecting means 8, the second circumferential velocity detecting means 9, and the third circumferential velocity detecting means 40, the control means 12 controls the operations of the approaching/separating means 11, the first driving means 6, the second driving means 7, the third driving means 39, and the coating section 51 on the basis of the control programs and the predetermined coating conditions.

Hereinafter, a description will be given as to how the production apparatus 1 performs application of the coating solution for forming the charge generating layer and the coating solution 3 for forming the charge transporting layer onto the cylindrical substrate 5. In this embodiment, the charge generating layer is formed underneath the charge transporting layer. Hence, the coating solution for forming the charge generating layer is applied to the cylindrical substrate 5 earlier than the coating solution 3 for forming the charge transporting layer.

Application of the coating solution for forming the charge generating layer to the cylindrical substrate 5 rotating about its axis is performed by driving the coating section 51 to eject the coating solution for forming the charge generating layer while moving parallelly in the axial direction of the cylindrical substrate 5.

Prior to a coating operation, the rotational speed of the cylindrical substrate 5 is set at a circumferential velocity value pre-determined in consideration of the type of an electrophotographic photoreceptor to be produced. After the starting of the operation, the circumferential velocity of the cylindrical substrate 5 is actually measured by the first circumferential velocity detecting means 8, and the detection output is inputted to the control means 12. In response to the detection output fed from the first circumferential velocity detecting means 8, the control means 12 controls the operation of the coating section 51 in such a way as to fulfill the discharge amount of the coating solution for forming the charge generating layer and the movement rate of the coating section 51 according to the above-described table data. When the count of rotation detected by the rotation count detecting means 10 has reached the predetermined rotation count set in the table data, in other words, when the film thickness of the charge generating layer has reached the predetermined value, the ejecting action and displacement of the coating section 51 are brought to an end under the control of the control means 12. In this way, the charge generating layer is formed on the cylindrical substrate 5 by the ink-jet coating method.

Application of the coating solution for forming the charge transporting layer to the cylindrical substrate 5, now having the charge generating layer thereon, is performed as follows. The outer peripheral surface of the coating roll 2 is allowed to wade across the coating solution 3 for forming the charge transporting layer stored in the pan acting as the coating solution supply means 4. Then, the thickness of the coating solution 3 membrane for forming the charge transporting layer deposited on the surface of the coating roll 2 is adjusted by the film thickness adjustment means 15. After that, the cylindrical substrate 5 is moved close to the coating roll 2, with a predetermined gap secured therebetween, so as to make contact with the coating film formed on the coating roll 2. Thereby, the coating film is transferred onto the cylindrical substrate 5.

After the starting of the coating operation, the cylindrical substrate 5 is adjusted to range in rotation from 1 to 20 times to make the film thickness uniform. Preferably, the count of rotation ranges from 1.5 to 10, more preferably, 2 to 5. If the count of rotation of the cylindrical substrate 5 is less than 1, part of the outer peripheral surface of the cylindrical substrate 5 is left uncoated, whereby making it impossible to obtain a uniform coating film. By way of contrast, if the count of rotation exceeds 20, much time needs to be spent in the coating operation, which leads to poor productivity. Hence, the count of rotation is set to fall in a range from 1 to 20.

Note that, in addition to making adjustment to the size of the gap between the metalling roll 13 and the coating roll 2 by the film thickness adjustment means 15 stated above, the film thickness of the coating solution 3 for forming the charge transporting layer to be transferred onto the cylindrical substrate 5 can be controlled also by making adjustment to the circumferential velocities of the coating roll 2 and the cylindrical substrate 5, the physical properties of the coating solution 3 for forming the charge transporting layer, the materials used for the surface parts of the cylindrical substrate 5 and the coating roll 2, and the size of the gap between the cylindrical substrate 5 and the coating roll 2.

During the application of the coating solution from the coating roll 2 to the cylindrical substrate 5, or equivalently, while the coating film is being transferred from the coating roll 2 onto the cylindrical substrate 5, the ratio between the circumferential velocity u1 of the cylindrical substrate 5 and the circumferential velocity u2 of the coating roll 2: the circumferential velocity ratio r (=u1/u2) should preferably be set to fall in a range from 0.7 to 1.4.

Hereinafter, the reason for limiting the range of the ratio r will be explained. In general, the flowing status of the coating solution on the surface of the cylindrical substrate 5 with respect to the ratio r between the circumferential velocity u1 of the cylindrical substrate 5 and the circumferential velocity u2 of the coating roll 2 varies with the ratio r. If the ratio r is unduly high, the coating solution will assume continual surface asperities that eventually develop ribs, which results in unevenness in coating film thickness. Thus, a lower limit needs to be imposed on the ratio r to prevent occurrence of the ribs. It has been known that the lower limit is regulated on the basis of the relationship between a capillary number Ca and a configuration parameter H0/D (H0: ½ of the distance between the cylindrical substrate 5 and the coating roll 2; D: the radius of the cylindrical substrate 5), and is eventually defined on the basis of the roll diameter, the size of the gap, the circumferential velocity, the viscosity of the coating solution, and the surface tension, each of which acts as an affector for the capillary number Ca and the configuration parameter H0/D. Prevention of occurrence of such ribs is of particular importance to form a coating film of uniform thickness on the cylindrical substrate 5. By setting the circumferential velocity ratio r between the cylindrical substrate 5 and the coating roll 2 in a range from 0.7 to 1.4, it is possible to form a rib-free uniform coating film.

After the starting of application of the coating solution 3 for forming the charge transporting layer, the rotation count detecting means 10 detects that the count of rotation of the cylindrical substrate 5 has reached the predetermined value, and simultaneously, in response to the detection output fed from the rotation count detecting means 10, the control means 12 controls the operation of the approaching/separating means 11 in such a way that the cylindrical substrate 5 is moved away from the coating roll 2, and also controls the operations of the first and second driving means 6 and 7 in such a way that the circumferential velocity V1 of the cylindrical substrate 5 is higher than the circumferential velocity V2 of the coating roll 2. At this time, it is preferable that the ratio R between the circumferential velocity V1 of the cylindrical substrate 5 and the circumferential velocity V2 of the coating roll 2 (=V1/V2) is adjusted to fall in a range from 1.2 to 15.0.

In accompaniment with the separating motion between the coating roll 2 and the cylindrical substrate 5, one of the two components is driven to rotate at higher circumferential velocity than the other. In this embodiment, however, the circumferential velocity V1 of the cylindrical substrate 5 is set to be higher than the circumferential velocity V2 of the coating roll 2. This is because, the cylindrical substrate 5 is made smaller in dimension than the coating roll 2, and is therefore more advantageous in terms of rotation speedup.

The values of the circumferential velocity u1 of the cylindrical substrate 5 and the circumferential velocity u2 of the coating roll 2, which correspond to a state where the cylindrical substrate is being coated with the coating solution 3 for forming the charge transporting layer 5 by the coating roll 2, may be identical with or different from the values of the circumferential velocity V1 of the cylindrical substrate 5 and the circumferential velocity V2 of the coating roll 2, respectively, that are determined in accompaniment with the separating motion of the cylindrical substrate 5 from the coating roll 2. For example, in a case where the above-described ratio r (=u1/u2) is set at 1.4 in the coating state, the cylindrical substrate 5 can be rotated at higher circumferential velocity than the coating roll 2 simply by separating the cylindrical substrate 5 and the coating roll 2 from each other. In most cases, however, the circumferential velocity u1 of the cylindrical substrate 5 and the circumferential velocity u2 of the coating roll 2 are equal in value, in other words, the ratio r is set at 1.0, in the coating state. Correspondingly, the before-separation circumferential velocity and the after-separation circumferential velocity of the coating roll 2 are adjusted to be equal (u2=V2), whereas the circumferential velocity of the cylindrical substrate 5 is increased upon the separating motion, that is; the circumferential velocity V1 is higher than the circumferential velocity u1.

In this embodiment, control of the circumferential velocity ratio R is exercised as follows. At the instant when the rotation count detecting means 10 detects that the predetermined rotation count has been reached, in response to the detection output, the control means 12 reads the table data corresponding to the target coating conditions stored in the memory 56. On the basis of the readout data, rotation control signals are outputted to drive the first and second driving means 6 and 7 in such a way as to fulfill the circumferential velocities V1 and V2 provided in the table data.

Note that control of the circumferential velocity ratio R is not limited to the manner as suggested in the above explanation, but may be of another manner. For example, the circumferential velocity of the cylindrical substrate and/or the coating roll may be changed as follows. In the coating state, the circumferential velocity of the cylindrical substrate is decreased by applying a load to the rotary shaft thereof, and, in accompaniment with the separating motion, the circumferential velocity of the cylindrical substrate is increased by getting rid of the load. In contrast to this, in accompaniment with the separating motion, the circumferential velocity of the coating roll is decreased by applying a load thereto, so that the circumferential velocity of the cylindrical substrate may go high relatively to the circumferential velocity of the coating roll. Moreover, as means for imposing a load to the rotary shaft, a few ways will be considered, i.e. realizing a brake by disposing a friction-enhancing element in the rotary shaft; and connecting the rotary shaft to a clutch. In the latter case, a load can be varied by changing the connection strength of the clutch.

In a case where the circumferential velocity V1 of the cylindrical substrate 5 and the circumferential velocity V2 of the coating roll 2, which correspond to the separation between the cylindrical substrate 5 and the coating roll 2, are equal to each other, even if they are kept separated successfully, the coating film put on the cylindrical substrate 5 and the coating film put on the coating roll 2 are forced to stretch under surface tension, thereby creating a connection made of the coating solution 3 for forming the charge transporting layer between the cylindrical substrate 5 and the coating roll 2. The connection made of the coating solution 3 for forming the charge transporting layer looks as if a bridge built across the cylindrical substrate 5 and the coating roll 2. Therefore, the formation of such a connection will be referred to as "bridged structure" for the sake of convenience.

In general, in a part of smaller thickness of a film, the solvent contained therein declines in concentration quickly. Therefore, this part is higher in surface tension than the other part. Since the above-described bridged structure portion has a small thickness, it follows that the coating solution for forming the charge transporting layer flows from the coating films put on the surfaces of the cylindrical substrate and the coating roll toward the bridged structure portion. As the separating motion between the cylindrical substrate and the coating roll proceeds, the bridged structure portion is cut off, whereupon an edge is created on the cut area thereof. Similarly, the coating solution for forming the charge transporting layer flows toward the edge portion, which results in an increase in the amount of the coating solution for forming the charge transporting layer in the edge portion. The edge portion, now carrying a larger amount of the coating solution for forming the charge transporting layer, cannot be leveled off satisfactorily by rotating the cylindrical substrate. As a consequence, a seam of large thickness is created.

On the other hand, in this embodiment, in accompaniment with the separating motion between the cylindrical substrate 5 and the coating roll 2, the circumferential velocity V1 of the cylindrical substrate 5 is adjusted to be higher than the circumferential velocity V2 of the coating roll 2. Thus, not only it is possible to apply a tension to the coating solution 3 for forming the charge transporting layer that forms a coating film in the separation direction, but it is also possible to apply a shear force thereto rapidly in the rotation direction. As a result, the stretched portion of the coating solution 3 for forming the charge transporting layer can be cut off successfully without creating the bridged structure, and thus it never occurs that the resultant coating film is seamed as described above. This makes it possible to form a coating film of uniform thickness on the surface of cylindrical substrate 5. In particular, by adjusting the circumferential velocity ratio R between the cylindrical substrate 5 and the coating roll 2 (=V1/V2) in a range from 1.2 to 15.0 in accompaniment with the separating motion, it is possible to prevent occurrence of the seam without fail. Preferably, the circumferential velocity ratio R ranges from 1.3 to 8.0. If the ratio R is less than 1.2, there will be not enough shear force, and thus occurrence of the seam cannot be prevented successfully. This leads to a failure of obtaining a coating film of uniform thickness. By way of contrast, if the ratio R exceeds 15.0, at about the time of the separating motion, the extent of speedup in rotation of the cylindrical substrate 5 will be so great that undulations appear on the coating film due to the acceleration of rotation. This makes it impossible to obtain a coating film of uniform thickness. In light of this, the circumferential velocity ratio R is set to fall in a range from 1.2 to 15.0.

In accompaniment with the separating motion between the coating roll 2 and the cylindrical substrate 5, shear force and tension are exerted so that the coating film portion stretched between the two components can be cut off without creating the bridged structure. After that, it is preferable that the coating film formed on the surface of the cylindrical substrate 5 is left to dry to some extent by driving the cylindrical substrate 5 to continue to rotate for a certain period of time. For example, in a case where a solvent having a high boiling point is used for the coating solution 3 for forming the charge transporting layer with which the cylindrical substrate 5 is coated, even after the completion of the separation between the coating roll 2 and the cylindrical substrate 5 subsequent to the application of the coating solution for forming the charge transporting layer to the cylindrical substrate 5, the coating solution 3 for forming the charge transporting layer that forms a coating film still possesses fluidity. Therefore, a possibility may arise where the coating film falls in drops due to the influence of gravity that will eventually cause unevenness in film thickness. Moreover, in a case where a solvent having relatively high volatility is used, to prevent undesirable dryness induced by solvent volatilization, it is preferable to provide, around the coating roll 2 and the cylindrical substrate 5 or on the platform 16, a cover member for covering the production apparatus 1 as a whole to bring the construction to a substantially hermetic state. This is effective in forming a coating film of uniform thickness.

Figure 4:
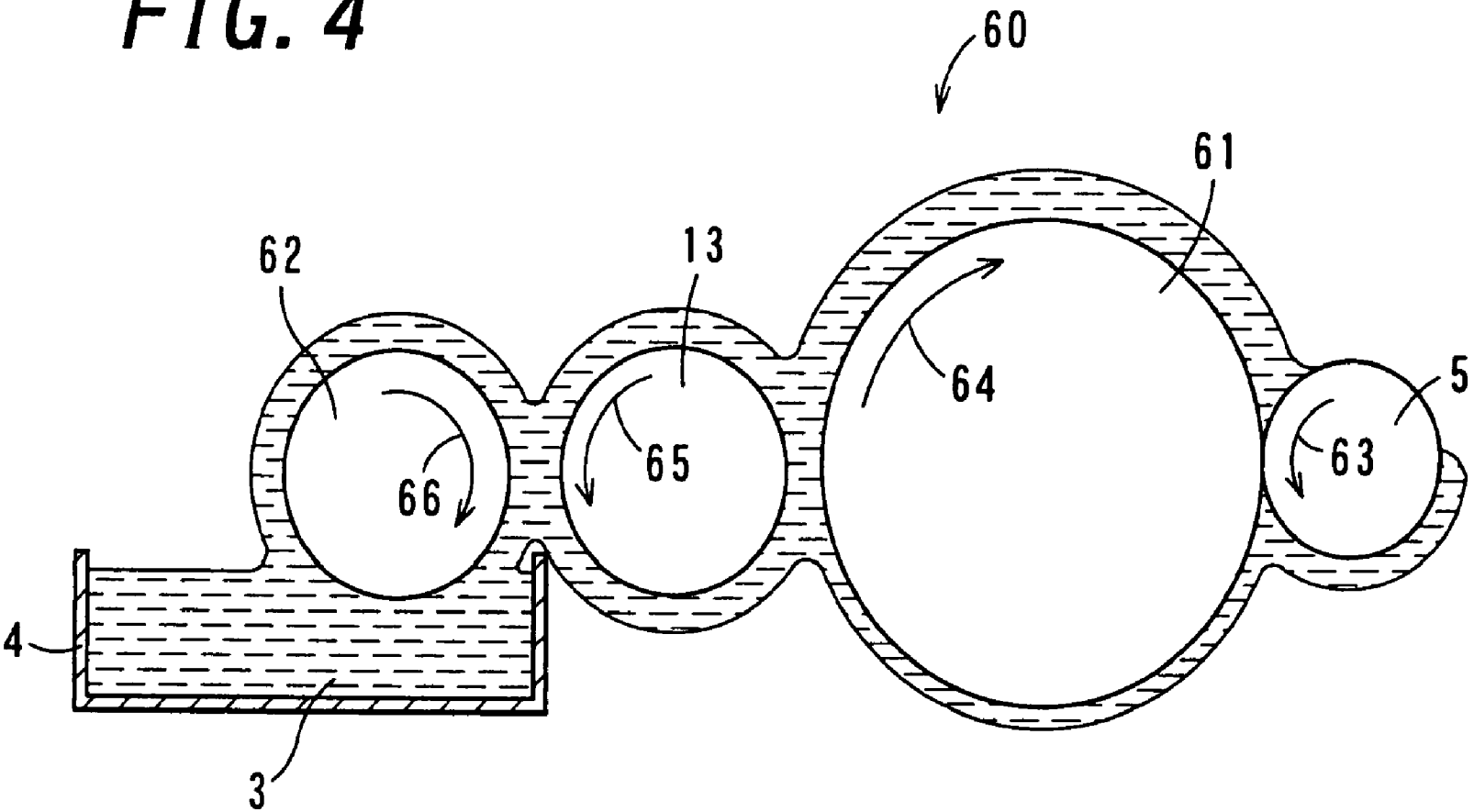
FIG. 4 is a sectional view showing a part for making up a roll of roll-coat type coating means employed in the production apparatus according to a second embodiment of the invention.

FIG. 4 is a sectional view showing a part for making up a roll of roll-coat type coating means 60 employed in the production apparatus according to a second embodiment of the invention. The roll-coat type coating means 60 of the production apparatus of the second embodiment is similar to the roll-coat type coating means 20 of the production apparatus 1 of the first embodiment, and therefore a plan view showing its configuration will be omitted. Moreover, the components that play the same or corresponding roles as in the first embodiment will be identified with the same reference symbols, and overlapping descriptions will be omitted.

In the roll-coat type coating means 60 of this embodiment, a coating roll containing an elastic surface 61 is so designed that at least its surface part is made of an elastic material. While the coating solution 3 for forming the charge transporting layer is being transferred from the coating roll containing an elastic surface 61 onto the cylindrical substrate 5, the rotation direction of the cylindrical substrate 5 (indicated by an arrow 63) rotating under a driving force of the first driving means 6 is reverse to the rotation direction of the coating roll containing an elastic surface 61 (indicated by an arrow 64) rotating under a driving force of the second driving means 7. The cylindrical substrate 5 is arranged in abutment with the coating roll containing an elastic surface 61, with the coating solution 3 for forming the charge transporting layer interposed therebetween, that is; the two are arranged in abutment with each other at a certain nip pressure. The roll-coat type coating means 60 of this embodiment is based on the natural roll coating method, in which the coating roll containing an elastic surface 61 and the cylindrical substrate 5 are rotated in opposite directions.

The preferred examples of the elastic material used to form at least the surface part of the coating roll containing an elastic surface 61 include: rubber materials such as silicon rubber, organic polysulfide rubber, nitrile-butadiene rubber, nitrosulfonated polyethylene, and styrene-butadiene rubber; resin materials such as silicon resin and fluorine resin; and a material formed by coating one of the aforementioned rubber materials with fluorine resin, for example.

Moreover, in the roll-coat type coating means 60, while the cleaning means is left out, the other metalling roll 62 is added. The metalling roll 13 is rotated in a direction indicated by an arrow 65 that is reverse to the rotation direction of the coating roll containing an elastic surface 61. On the other hand, the other metalling roll 62 is rotated in a direction indicated by an arrow 66 that is identical with the rotation direction of the coating roll containing an elastic surface 61, yet reverse to the rotation direction of the metalling roll 13. The gap between the coating roll containing an elastic surface 61 and the metalling roll 13, as well as the gap between the two metalling rolls 13 and 62, is adjusted to a desired value by the adjustment member 14*a*, 14*b* and the adjustment member 44*a*, 44*b*.

Part of the other metalling roll 62 is immersed in the coating solution 3 for forming the charge transporting layer stored in the coating solution supply means 4. The coating solution 3 for forming the charge transporting layer that adhered to the other metalling roll 62 is supplied to the coating roll containing an elastic surface 61 by way of the metalling roll 13, and is thereby transferred onto the cylindrical substrate 5. The coating thickness is determined mainly on the basis of the dimension of the gap left between the metalling rolls 13 and 62, and the dimension of the gap left between the metalling roll 13 and the coating roll containing an elastic surface 61. The secondary determinants include: the physical properties of the coating solution; the circumferential velocity of each roll; the nip pressure; and the material used for the coating roll containing an elastic surface 61.

As a way to control the circumferential velocity ratio R, the circumferential velocities of the cylindrical substrate 5 and the coating roll containing an elastic surface 61 corresponding to the separation therebetween are set at V1 and V2, respectively, by controlling the operations of the first and second driving means 6 and 7. In the case of adopting the natural roll coating method, the control of the circumferential velocity ratio R can be exercised as follows, instead. For example, in a case where the before-separation circumferential velocity u1 of the cylindrical substrate 5 is set to be higher than the before-separation circumferential velocity u2 of the coating roll containing an elastic surface 61, since the surface part of the coating roll containing an elastic surface 61 is made of an elastic material, by bringing the coating roll containing an elastic surface 61 into abutment with the cylindrical substrate 5 under a certain nip pressure, it is possible to enable the coating roll containing an elastic surface 61 to act as a friction-enhancing element, namely, a brake, with respect to the cylindrical substrate 5. Upon the coating roll containing an elastic surface 61 and the cylindrical substrate 5 changing from the abutting state to a separating state, the braking effect, namely, frictional force acting on the cylindrical substrate 5 ceases to exist. In the absence of the frictional force, the cylindrical substrate 5 is allowed to rotate at a higher circumferential velocity than the coating roll containing an elastic surface 61. That is, the circumferential velocity of the cylindrical substrate 5 can be changed instantly in accompaniment with the separating motion so as to be higher than the circumferential velocity of the coating roll containing an elastic surface 61.

Figure 5:
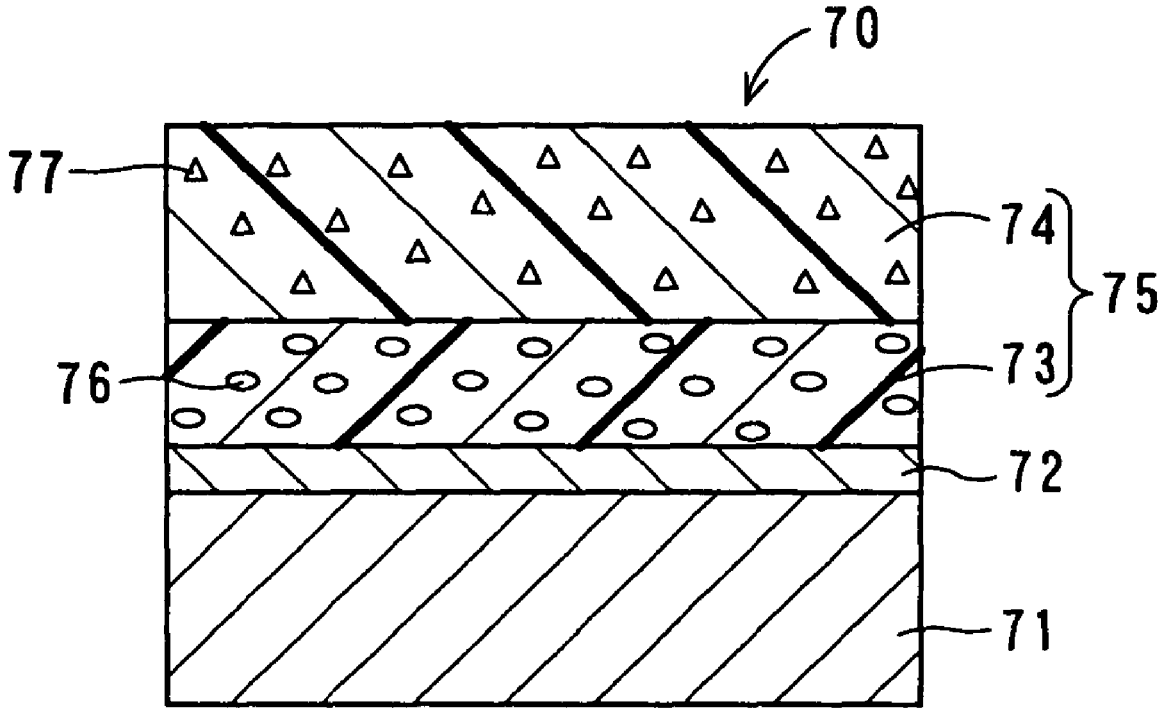
FIG. 5 is a partial sectional view showing a simplified configuration of an electrophotographic photoreceptor.

FIG. 5 is a partial sectional view showing a simplified configuration of an electrophotographic photoreceptor 70. The electrophotographic photoreceptor 70 is produced by the production apparatus of the first or second embodiment of the invention. The electrophotographic photoreceptor 70 shown in FIG. 5 is of laminate type that is constituted by stacking, on a conductive support 71 built as a cylindrical substrate, an intermediate layer 72, a charge generating layer 73 including a charge generating substance 76, and a charge transporting layer 74 including a charge transporting substance 77 successively in the order named. The charge generating layer 73 and the charge transporting layer 74 constitute a photoconductive layer 75. In the electrophotographic photoreceptor 70, the intermediate layer 72 and the charge transporting layer 74 are formed by the roll-coat type coating means 20, whereas the charge generating layer 73 is formed by the ink-jet type coating means 50.

The intermediate layer 72 helps prevent electrical charge injection from the conductive support 71 into the photoconductive layer 75, and thereby avoid deterioration of the chargeability of the electrophotographic photoreceptor 70. According to the electrophotographic photoreceptor 70 having the intermediate layer 72 formed thereon, reduction in the surface charge other than the one to be eliminated through photo-exposure can be suppressed. This makes it possible to avoid occurrence of image defects such as fogging. Moreover, the intermediate layer 72 covers an imperfection on the surface of the conductive support 71, whereby making it possible to obtain surface evenness. Thus, the film formability of the photoconductive layer 75 can be improved. Further, the intermediate layer 72 helps prevent the photoconductive layer 75 from falling off from the conductive support 71, and thereby improve the layer adhesion with respect to the conductive support 71.

The surface of the electrophotographic photoreceptor 70 with the photoconductive layer 75 is negatively charged by a charger or the like device, and the charge generating layer 73 is irradiated with light having an absorption wavelength. Thereupon, electrons and positive hole charge are produced in the charge generating layer 73. The positive hole is moved to the surface of the electrophotographic photoreceptor 70 by the charge transporting substance 77 contained in the charge transporting layer 74, for neutralizing the negative charge on the surface. The electrons developed in the charge generating layer 73 travel toward the positively-charged conductive support 71, for neutralizing the positive charge. In this way, the electrophotographic photoreceptor 70 of laminate type is brought into a working state.

Although the electrophotographic photoreceptor 70 shown in FIG. 5 has the charge transporting layer 74 on its outermost side, in other words, the photoconductive layer 75 makes up the top surface of the electrophotographic photoreceptor 70, the layer arrangement is not limited thereto. For example, a protective layer may additionally be formed on the photoconductive layer 75. By adding the protective layer, not only it is possible to improve the plate life of the photoconductive layer 75, but it is also possible to avoid a chemical detrimental effect such as ozone or nitrogen oxide resulting from a corona discharge generated at the time of electrifying the surface of the electrophotographic photoreceptor 70. Moreover, a conductivity-imparted coating film made of carbon paste or silver paste may additionally be formed on the conductive support 71 and yet underneath the intermediate layer 72. This helps prevent non-uniformity of the conductivity of the conductive support 71.

Hereinafter, a detailed description will be given as to the layer configuration and constituent materials associated with the electrophotographic photoreceptor 70. For example, the conductive support 71 may be made of a metal material such as aluminum, aluminum alloy, copper, zinc, stainless steel, or titanium. However, the material used for the conductive support 71 is not limited thereto. Other than these materials, the following can also be used: a polymeric material such as polyethylene terephthalate, polyester, polyoxymethylene, or polystyrene; or a hard-paper or glass material having a metal-foil laminated surface, a surface on which a metal material is vapor-deposited, or a surface on which a layer of conductive compound is vapor-deposited or coated, for example conductive high polymer, tin oxide, indium oxide, carbon particles, or metal particles. On an as needed basis, the surface of the conductive support 71 may be subjected to an anodic oxidation coating treatment, a chemical-agent treatment, a hydrothermal treatment, a coloring treatment, or a diffuse-reflection treatment that comprises forming a rough finish, within the bounds of not affecting image quality. In an electrophotographic process using a laser as an exposure light source, since laser light beams are equal in wavelength, incident laser light and light reflected within the electrophotographic photoreceptor interfere with each other, in consequence whereof there results an interference fringe pattern on an image. This leads to image defects. By performing the aforementioned diffused-reflection treatment on the surface of the conductive support 71, it is possible to avoid occurrence of image defects resulting from interference of laser light of uniform wavelength.

The preferred examples of the material used to form the intermediate layer 72 include: polyamide; polyurethane; cellulose; nitro-cellulose; polyvinyl alcohol; polyvinyl pyrrolidone; polyacrylamide; aluminum anodic oxidation coating; gelatin; starch; casein; and N-methoxymethylated nylon. In the material for use, particles of titanium oxide, tin oxide, or aluminum oxide may be dispersed. The intermediate layer 72 ranges in film thickness from ca. 0.1 to 10 μm. As described previously, the intermediate layer 72 such as shown herein contributes to adhesion between the conductive support 71 and the photoconductive layer 75, and also serves as a barrier layer for preventing electrical charge injection from the conductive support 71 into the photoconductive layer 75. The chargeability of the electrophotographic photoreceptor 70 can thus be maintained properly by dint of the intermediate layer 72; wherefore the service life of the electrophotographic photoreceptor 70 per se can be prolonged.

Known substances that may be used for the charge generating substance 76 of the charge generating layer 73 include: a phthalocyanine based compound; an azo based compound; a quinacridon based compound; a polycyclic quinine based compound; and a perylene based compound. As organic dyestuffs, thiapyrylium salt and squarylium salt have been known. In particular, a phthalocyanine based compound is suitable, and a titanylphthalocyanine based compound would be the optimum choice. In addition to the pigments and dyestuffs enumerated, a chemical sensitizer or optical sensitizer may be added to the charge generating layer 73. As a chemical sensitizer, an electron-acceptor substance may be used, for example, cyano compounds such as tetracyanoethylene and 7,7,8,8-tetracyanoquinodimethane, or quinone groups such as anthraquinone and p-benzoquinone, or nitro compounds such as 2,4,7-trinitrofluorenone and 2,4,5,7-tetranitrofluorenone. As an optical sensitizer, a color material may be used, for example, xanthene series pigments, thiazine pigments, or triphenylmethane series pigments. Among those charge generating substances, organic photoconductive compounds such as organic pigments or organic dyestuffs are particularly desirable.

The coating solution for forming the charge generating layer 73 is prepared by dispersing the aforementioned charge generating substance 76, together with binder resin, in an appropriate solvent. The examples of the binder resin for use include: polyarylate; polyvinyl butyral; polycarbonate; polyester; polystyrene; polyvinyl chloride; phenoxy resin; epoxy resin; silicon; and polyacrylate.

The solvent for use is preferably a mixture of some of the following substances: isopropyl alcohol; toluene; xylene; acetone; methylethyl ketone; ethyl cellosolve; ethyl acetate; methyl acetate; dichloromethane; dichloroethane; monochloro benzene; ethylene grycol dimethylether; cyclohexanone; pyrrolidone; and n-methyl pyrrolidone.

One or two or more of the solvent materials selected among from cyclohexanone, pyrrolidone, and n-methyl pyrrolidone, each having a boiling point as high as 120° C. or above, should preferably be contained in the coating solution for forming the charge generating layer in the range of 5 to 40% by weight. Other than the aforementioned substances, the following can also be used to prepare a mixture used as a solvent for the coating solution for forming the charge generating layer: alcohol groups; ketone groups; amide groups; ester groups; ether groups; hydrocarbon groups; chlorinated hydrocarbon groups; and aromatic groups. In any case, by adjusting the composition ratio of the charge generating substances, the binder resin, and the mixed solvents, it is possible to keep the viscosity of the coating solution for forming the charge generating layer at 10 m Pa·s or below. This makes it possible to avoid occurrence of nozzle clogging, and thereby maintain stable nozzle dischargeability and also attain an enhanced after-coating leveling effect.

The coating solution for forming the charge generating layer is prepared by dispersing, in the solvent, the charge generating substances pulverized with use of a ball mill, sand grinder, paint shaker, or ultrasonic dispersing device, followed by adding there to binder resin as required. The intermediate layer 72 is coated with the coating solution for forming the charge generating layer thus prepared by the ink-jet type coating means 50. Upon dry-hardening the coating solution for forming the charge generating layer, the charge generating layer 73 is formed. Preferably, the film thickness of the charge generating layer 73 ranges from ca. 0.05 to 5 μm, more preferably, ca. 0.1 to 1 μm.

The charge transporting layer 74 is formed by admixing in binder resin the charge transporting substance 77 capable of receiving and transporting charge generated in the charge generating substance 76. A hole transporting substance or electron transporting substance may be used as the charge transporting substance 77.

Known substances that may be used as the hole transporting substance for use include: carbazole derivative; pyrene derivative; oxazole derivative; oxadiazole derivative; thiazole derivative; thiadiazole derivative; triazole derivative; imidazole derivative; imidazolone derivative; imidazolidine derivative; bisimidazolidine derivative; a styryl compound; a hydrazone compound; a polycyclic aromatic series compound; indole derivative; pyrazoline derivative; oxazolone derivative; benzimidazole derivative; quinazoline derivative; benzofuran derivative; acridine derivative; phenazine derivative; aminostilbene derivative; triarylamine derivative; triarylmethane derivative; phenylenediamine derivative; stilbene derivative; enamine derivative; and benzidine derivative. Moreover, a polymer having a group belonging to such a compound/derivative in a main or side chain thereof may also be used. For example, poly-N-vinyl carbazole; poly-1-vinylpyrene; ethylcarbazole-formaldehyde resin; triphenylmethane polymer; poly-9-vinyl anthracene; and polysilane have been known.

Known substances that may be used as the electron transporting substance for use include: organic compounds such as benzoquinone derivative, tetracyanoethylene derivative, tetracyanoquinodimethane derivative, fluorenone derivative, xanthone derivative, phenanthraquinone derivative, phthalic anhydride derivative, and diphenoquinone derivative; and inorganic materials such as amorphous silicon, amorphous selenium, tellurium, selenium-tellurium alloy, cadmium sulfide, antimony sulfide, zinc oxide, and zinc sulfide. However, the charge transporting substance is not limited thereto, and these substances can either be used alone or by way of a mixture of two or more.

The binder resin used for the charge transporting layer 74 is selected from resin materials having excellent miscibility with the charge transporting substance 77. The specific examples thereof include: vinyl polymer resin such as polymethylmethacrylate resin, polystyrene resin, polyvinyl chloride resin, and copolymers of such resin materials; and other resin materials such as polycarbonate resin, polyester resin, polyester carbonate resin, polysulfone resin, phenoxy resin, epoxy resin, silicon resin, polyarylate resin, polyamide resin, methacrylic resin, acrylic resin, polyether resin, polyurethane resin, polyacrylamide resin, and phenol resin. Moreover, heat-settable resin obtained by partly cross-linking such resin materials may also be used. These resin materials can either be used alone or by way of a mixture of two or more. Among the aforementioned resin materials, polystyrene resin, polycarbonate resin, and polyarylate resin, and also polyphenylene oxide are particularly desirable as the binder resin because of their excellence in electrical insulation property (volume resistivity: $10^{13}\Omega$ or above), film formability, and potential characteristics.

On an as needed basis, an additive such as a plasticizer or surface reforming agent may be added to the charge transporting layer 74 in order to improve the film formability, flexibility, and surface smoothness. The examples of the plasticizer include: biphenyl; chlorinated biphenyl; benzophenone; o-terphenyl; dibasic acid ester; fatty acid ester; phosphoric acid ester; phthalic acid ester; fluoro series of hydrocarbons; chlorinated paraffin; and epoxy-type plasticizer. The examples of the surface reforming agent include silicon oil and fluorine resin. Moreover, fine particles of inorganic compounds or organic compounds may be added to the charge transporting layer 74 in order to improve the mechanical strength and electric characteristics. Further, additives of various kinds, such as an antioxidant and a sensitizer may also be added thereto as required. By doing so, the following advantages are gained; the potential characteristics can be improved; the stability of the coating solution for forming the charge transporting layer can be increased; and fatigue-induced quality degradation of the electrophotographic photoreceptor resulting from repeated usage can be lessened, thereby improving the durability.

As a suitable antioxidant, hindered phenol derivative, hindered amine derivative, or a mixture of hindered phenol derivative and hindered amine derivative may be used.

The coating solution 3 for forming the charge transporting layer is prepared by dissolving or dispersing, in an appropriate solvent, the charge transporting substance 77, binder resin, and also an additive, as needed. The examples of the solvent used for the coating solution 3 for forming the charge transporting layer include: aromatic series hydrocarbons such as benzene, toluene, xylene, mesitylene, tetralin, diphenylmethane, dimethoxy benzene, and dichloro benzene; hydrocarbon halides such as dichloromethane and dichloroethane; ether groups such as THF, dioxane, dibenzylether, and dimethoxy methylether; ketone groups such as cyclohexanone, acetophenone, and isophorone; ester groups such as methyl benzoate and ethyl acetate; a sulfur-containing solvent such as diphenyl sulfide; a fluorinated solvent such as hexafluoroisopropanol; and an aprotic polar solvent such as N,N-dimethylformamide. These solvent materials can either be used alone or by way of a mixture of two or more. Moreover, on an as needed basis, other types of solvents such as alcohol groups, acetonitrile, or methyl ethyl ketone may be added to the solvent selected from the aforementiomed materials.

The charge transporting layer 74 is formed by coating the charge generating layer 73 with the coating solution 3 for forming the charge transporting layer by the roll-coat type coating means 20. Preferably, the film thickness of the charge transporting layer 74 ranges from 5 to 50 μm, more preferably, 10 to 40 μm. If the thickness of the charge transporting layer 74 is less than 5 μm, the electrophotographic photoreceptor 70 will be decreased in charge-holding capacity on its surface. By way of contrast, if the thickness of the charge transporting layer 74 exceeds 50 μm, the electrophotographic photoreceptor 70 will be decreased in resolution. Accordingly, the film thickness of the charge transporting layer 74 is set to fall in a range from 5 to 50 μm.

As described earlier, the electrophotographic photoreceptor may have a protective layer on its outermost side, in other words, a protective layer may be formed on the photoconductive layer. By adding the protective layer, not only it is possible to improve the plate life of the photoconductive layer, but it is also possible to free the photoconductive layer from a chemical detrimental effect such as ozone or nitrogen oxide resulting from a corona discharge generated at the time of electrifying the surface of the electrophotographic photoreceptor. For example, the protective layer is made of a resin material such as resin containing an inorganic filler, or inorganic oxide.

The specific examples of the resin material used for the protective layer include: ABS resin; ACS resin; olefin-vinyl-monomer copolymer; chlorinated polyether; allyl resin; phenol resin; polyacetal; polyamide; polyamide imide; polyacrylate; polyallyl sulfone; polybutylene; polybutylene terephthalate; polycarbonate; polyether sulfone; polyethylene; polyethylene terephthalate; polyimide; acrylic resin; polymethyl bentene; polypropylene; polyphenylene oxide; polysulfone; polystyrene; AS resin; butadiene-styrene copolymer; polyurethane; polyvinyl chloride; polyvinylidene chloride; and epoxy resin. For the purpose of increasing the abrasion resistance, fluorinated resin such as polytetrafluoroethylene, or silicon resin may be admixed in the protective layer. Moreover, an inorganic filler or organic filler which exhibits high solidity may be added to such a resin material.

Preferably, the filler for use ranges in average particle diameter from 0.02 to 3 μm, more preferably, 0.05 to 1 μm. If the average particle diameter is less than 0.02 μm, the protective layer will be decreased in abrasion resistance, which shortens the service life of the electrophotographic photoreceptor. By way of contrast, if the average particle diameter exceeds 3 μm, a scattering of light will be caused by the protective layer. This gives rise to a problem of low resolution.

The specific examples of the filler to be added to the protective layer include: titanium oxide; tin oxide; zinc oxide; zirconium oxide; indium oxide; silicon nitride; calcium oxide; barium sulfate; ITO; silica; colloidal silica; alumina; carbon black; fluorinated resin fine particles; polysiloxane based resin fine particles; and fine particles of high polymeric charge transporting substance. These materials can either be used alone or by way of a mixture of two or more.

The filler for use may preferably be subjected to a known surface treatment using inorganic or organic substances from the viewpoint of dispersibility improvement and surface nature modification. In general, the surface of the filler may be treated with a silane coupling agent, a fluorinated silane coupling agent, or higher fatty acid, or may be co-polymerized with high polymer or the like material (the aforesaid are water-repellent treatments), or may be treated with alumina, zirconia, tin oxide, or silica (the aforesaid are inorganic substance treatments).

The filler is pulverized or simply dispersed, together with binder resin and/or the charge transporting substance and a dispersion solvent, before being applied as the protective layer. Preferably, the content of the filler in the resultant protective layer falls within the range of 5 to 50% by weight, more preferably, 10 to 40% by weight. If the content of the filler is less than 5% by weight, sufficient abrasion resistance cannot be attained. Byway of contrast, if the content of the filler exceeds 50% by weight, the transparency of the protective layer will be impaired. This gives rise to a problem of poor sensitivity. The examples of the dispersion solvent for use include: ketone groups such as methylethyl ketone, acetone, methyl isobutyl ketone, and cyclohexanone; ether groups such as dioxane, tetrahydrofuran, and ethylcellosolve; aromatic groups such as toluene and xylene; halogen groups such as chlorobenzene and dichloromethane; and ester groups such as ethyl acetate and butyl acetate.

In the case of conducting a pulverization process, a ball mill, a sand mill, a vibration mill, or the like grinding device is employed. Moreover, with the aim of transporting a hole or electron in an efficient manner, the charge transporting substance explained previously, i.e., the hole transporting substance or electron transporting substance may be added to the protective layer. Further, with the aim of improving the chargeability and other characteristics, a phenol compound, a hydroquinone compound, a hindered phenol compound, a hindered amine compound, or a compound having both the structures of a hindered amine and a hindered phenol in the same molecule may be added thereto. Addition of a plasticizer and/or a leveling agent may also possible. As a plasticizer, a commonly-used resin plasticizer may be used, for example dibutyl phthalate or dioctyl phthalate. The content of the plasticizer for use should preferably be set at 30% by weight or below relatively to adhesive resin. As a leveling agent, a silicon oil material such as dimethyl silicon oil or methylphenyl silicon oil, or a polymer having a perfluoroalkyl group in a side chain thereof, or oligomer may be used. The content of the leveling agent for use should preferably be set at 1% by weight or below relatively to adhesive resin.

In a case where the protective layer is composed at least of a settable resin layer, the layer may be obtained by exploiting a variety of cross-linking reactions generally known in the field of material development, for example, radical polymerization, ion polymerization, thermal polymerization, photo-induced polymerization, and irradiation-induced polymerization. Moreover, by cross-linking a material having a silicon conformation, perfluoroalkyl conformation, or long-chain alkyl conformation through a known method, it is possible to realize a cured protective layer of low surface energy. Preferably, the film thickness of the protective layer ranges from 0.5 to 5 μm, more preferably, 1 to 3 μm. If the film thickness of the protective layer is less than 0.5 μm, the protective layer will be prone to peeling off from the interface with the lower photoconductive layer when it undergoes an external force produced upon contact with a blade or a charging roller. This is because, if the thickness is unduly small, the protective layer will no longer withstand the influence of the external force on its own, and resultantly the interface between the protective layer and the photoconductive layer is constantly loaded with a force. Prolonged loading of a force may cause a deviation at the interface. Furthermore, there is a risk that the whole of the protective layer is worn away completely before the electrophotographic photoreceptor reaches the end of its life cycle. By way of contrast, if the film thickness of the protective layer exceeds 5 μm, charge carriers will be diffused while traveling within the protective layer. This gives rise to problems of thickening of printed characters and a rise in residual potential resulting from poor sensitivity and repeated usage.

EXAMPLES

Hereinafter, examples of the invention will be described. Note that the examples are provided for illustrative purposes only, and are not intended to limit the scope of the invention.

Example 1

As the conductive support, there was fabricated an aluminum-made unmachined cylindrical tube which is 30 mm in diameter and 360 mm in length by the Expand Draw (ED) method.

Thence, a coating solution for forming the intermediate layer was prepared as follows. At the outset, there was formed a mixed solvent comprising 41 parts by weight of 1,3-dioxolane and 41 parts by weight of methanol. Subsequently, 9 parts by weight of dendritic titanium oxide having been surface-treated with aluminum oxide ($Al_2O_3$) and zirconium dioxide ($ZrO_2$) (manufactured by Ishihara Sangyo Co., Ltd.: TTO-D-1) and 9 parts by weight of copolymer nylon resin (manufactured by Toray Industries, Inc.: CM 8000) were admixed in the mixed solvent. After that, the mixture was dispersed for 8 hours with use of a paint shaker. The coating solution for forming the intermediate layer thus prepared was filled in a coating reservoir, so that the conductive support may be immersed in the coating solution. Upon raising the sunken conductive support after the dipping process, the conductive support was coated with a 1.0 μm-thick intermediate layer.

Next, the coating solution for forming the charge generating layer was prepared by mixing together 1 part by weight of oxotitanium phthalocyanine pigments having a crystal conformation that exhibits clear diffraction peaks at least at a Bragg angle (2θ±0.2°) of 27.2° according to the Cu—Kα characteristic X-ray (wavelength: 1.54 Å) diffraction spectrum, 1 part by weight of polyvinyl butyral resin (manufactured by Denki Kagaku Kogyo K.K., Trade name: #6000-C), 83 parts by weight of tetrahydrofuran, and 15 parts by weight of cyclohexanone, followed by dispersing the mixture for 12 hours with use of a paint shaker.

The conductive support with the intermediate layer formed thereon was installed in the production apparatus of the second embodiment. Then, the coating device acting as the inkjet type coating means (manufactured by Sharp Corporation: AJ 2000 renovated model) disposed above the conductive support was driven to eject the above-described coating solution for forming the charge generating layer toward the conductive support rotating at 60 rpm. At this time, a coating solution droplet was ejected from the head of the coating device driven by the piezoelectric method with a volume of 30 pl to form a single dot. The coating solution was then left to air-dry, and thereby a 0.2 μm-thick charge generating layer was formed on the intermediate layer.

Further, the coating solution for forming the charge transporting layer was prepared by dissolving, in 104 parts by weight of xylene, 10 parts by weight of triphenylamine dimer (TPD for short) defined by the structural formula (I) for the charge transporting substance, 16 parts by weight of polycarbonate resin (manufactured by Mitsubishi Engineering Plastics Corporation, Trade name: Iupilon Z 300) used as binder resin, 1 part by weight of 2,6-di-t-butyl-4-methylphenol, and 0.008 parts by weight of diphenyl polysiloxane (manufactured by Shin-Etsu Chemical Co., Ltd.: KF-50).

The charge generating layer was coated with the coating solution for forming the charge transporting layer thus prepared by the roll-coat type coating means of the production apparatus (based on the natural roll coating method as shown in FIG. 4). While the coating solution for forming the charge transporting layer was being applied and transferred onto the charge generating layer formed on the conductive support, the coating roll, the metalling roll, and the conductive support were each operated at a circumferential velocity of 10 m/min. Moreover, the size of the gap between one and the other metalling rolls was set at 170 μm, whereas the size of the gap between the metalling roll and the coating roll was set at 100 μm.

At first, the coating solution for forming the charge transporting layer was supplied from the coating solution supply means to the outer peripheral surface of the metalling roll, while rotating all of the rolls as well as the conductive support. By the action of the two metalling rolls, a coating film of uniform thickness was formed. After that, the coating roll was rotatably driven to move close to the metalling roll until the distance therebetween reaches the predetermined value of the gap size as described above, so that the coating film put on the surface of the metalling roll may be transferred onto the coating roll. Subsequently, the conductive support, now carrying the intermediate layer and the charge generating layer formed in the above-described manner, was rotatably driven to make contact with the coating roll to begin a coating operation.

After the starting of the coating operation, at the instant when the count of rotation of the conductive support has reached the predetermined rotation count: 2 times, the conductive support was driven to move away from the coating roll at a separation speed of 50 mm/sec. Concurrently with the separating motion, the circumferential velocity of the conductive support was increased from 10 m/min to 18 m/min. At about the time of the separating motion, the circumferential velocity of the coating roll was kept at 10 m/min. In this way, the circumferential velocity ratio R between the circumferential velocity V1 of the conductive support and the circumferential velocity V2 of the coating roll (=V1/V2) was adjusted to be 1.8. Moreover, in a state where the coating roll and the conductive support were kept separated from each other, the conductive support was driven to continue to rotate for 20 seconds. After that, the conductive support was left to dry for an hour, thereby forming a 23 μm-thick charge transporting layer. Thereupon, the electrophotographic photoreceptor of Example 1 was fabricated.

(I)

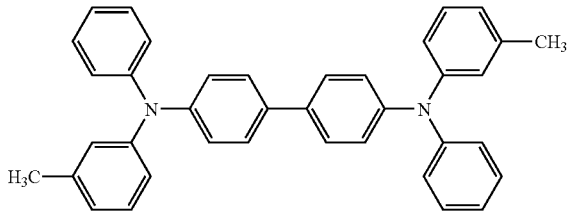

Example 2

The electrophotographic photoreceptor of Example 2 produced has basically the same structure as that of Example 1, and the only difference is that, in the former, pyrrolidone was used as a dispersion fluid for the charge generating layer instead of cyclohexanone.

Example 3

The electrophotographic photoreceptor of Example 3 produced has basically the same structure as that of Example 1, and the only difference is that, in the former, n-methyl pyrrolidone was used as a dispersion fluid for the charge generating layer instead of cyclohexanone.

Example 4

The electrophotographic photoreceptor of Example 4 produced has basically the same structure as that of Example 1, and the only difference is that, in the former, a dispersion fluid for the charge generating layer was prepared by using 35 parts by weight of cyclohexanone and 63 parts by weight of tetrahydrofuran.

Comparative Example 1

The electrophotographic photoreceptor of Comparative Example 1 produced has basically the same structure as that of Example 1, and the only difference is that, in the former, the charge generating layer and the charge transporting layer were formed by the dip coating method.

Characteristic evaluation was conducted on each of the above-described electrophotographic photoreceptors in the process of being produced. Moreover, the electrophotographic photoreceptors in finished form were each mounted on a full-color copier with a tandem image processing system (manufactured by Sharp Corporation: AR-C 260) to perform image formation in the normal range of ambient temperature and humidity (25° C./50%). Then, characteristic evaluation was conducted.

Hereinafter, a description will be given as to evaluation methods and criteria provided according to the characteristics to be reviewed.

(Evaluation of Ink-Jet Dischargeability)

After the coating solution for forming the charge generating layer was applied to a single conductive support with the intermediate layer formed thereon, a check was made to the nozzle of the ink-jet type coating device. The following are evaluation criteria.

○: free from nozzle clogging, satisfactory level

X: nozzle clogging being present (Evaluation of Stability in Preservation of Coating Solution for Forming the Charge Generating Layer)

The coating solution for forming the charge generating layer was poured into a sample bottle, and was then left intact for a week at a temperature of 25° C. After that, the presence or absence of precipitation and coagulation has been confirmed. The following are evaluation criteria.

○: neither precipitation nor coagulation being present

Δ: precipitation being present, but easily re-dispersible, no coagulation being present X: both precipitation and coagulation being present (Evaluation of Outer Appearance)

After the formation of the charge generating layer and the charge transporting layer, their film coating conditions were visually checked. The following are evaluation criteria.

○: uniformity being observed, satisfactory level

X: lack of uniformity, unsatisfactory (Half-Tone Image Uniformity)

A half-tone image was formed by the aforementioned image forming apparatus AR-C 260 on which each of the electrophotographic photoreceptors is mounted. Note that a half-tone image refers to an image whose gradation is represented by white and black dots. The half-tone image produced was visually checked to evaluate half-tone image uniformity. The following are evaluation criteria.

○: no problem in practical use

X: problem being encountered in practical use (Image Defects)

A test chart was formed by the aforementioned image forming apparatus AR-C 260 on which each of the electrophotographic photoreceptors is mounted. The test chart produced was visually checked to confirm the presence or absence of image defects such as fogging or black points. The following are evaluation criteria.

○: no problem in practical use

X: problem being encountered in practical use (Production Time)

Production time evaluation was conducted on the basis of the time spent in the coating operation, exclusive of the time spent in preparing the coating solutions. The following are evaluation criteria: 3.5 min or below in a dip coating operation: 3.0 min or below in an ink-jet coating operation; and 1.0 min or below in a roll coating operation. The productivity is considered to be at a satisfactory level when the operation time is equal to or less than the aforementioned value (○), yet considered to be at an unsatisfactory level when the aforementioned value is exceeded (X).

Listed in Table 1 are evaluation results. Note that the viscosity of each coating solution for forming the charge generating layer shown in Table 1 was measured by the use of the rotational E-type viscometer manufactured by Toki Sangyo Co., Ltd. As seen from the table, all of the electrophotographic photoreceptors of Examples 1 through 4 produced according to the invention succeeded in providing satisfactory characteristics in the process of being produced. The images produced by them were also excellent in quality, and the time spent in the image formation was short enough. With all things considered, the electrophotographic photoreceptors of Examples 1 through 4 can be rated highly. On the other hand, according to the electrophotographic photoreceptor of Comparative Example 1 in which the charge generating layer and the charge transporting layer were formed by the dip coating method, although its characteristics were not problematic, much time was required for the formation. That is, the electrophotographic photoreceptor of Comparative Example 1 was found to be disadvantageous in productivity.

TABLE 1

| | Charge generating Layer | | | Outer appearance | | Image characteristics | | |
|---|---|---|---|---|---|---|---|---|
| Photoreceptor | Dischargeability | Preservation stability | Fluid viscosity (mPa · s) | Charge generating layer | Charge transporting layer | HT image uniformity | Image defects | Production time |
| Example 1 | ○ | ○ | 3.2 | ○ | ○ | ○ | ○ | ○ |
| Example 2 | ○ | ○ | 2.5 | ○ | ○ | ○ | ○ | ○ |
| Example 3 | ○ | ○ | 2.8 | ○ | ○ | ○ | ○ | ○ |
| Example 4 | ○ | ○ | 3.5 | ○ | ○ | ○ | ○ | ○ |
| Comparative Example 1 | — | ○ | 2.1 | ○ | ○ | ○ | ○ | X |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for producing an electrophotographic photoreceptor that is obtained by coating on a cylindrical substrate or an intermediate layer formed on the cylindrical substrate, at least two layers: a charge generating layer containing a charge generating substance and a charge transporting layer containing a charge transporting substance, comprising the steps of:

forming the charge generating layer by applying a coating solution for forming the charge generating layer onto the cylindrical substrate or an intermediate layer formed on the cylindrical substrate by an ink-jet coating method; and forming the charge transporting layer by applying a coating solution for forming the charge transporting layer onto the charge generating layer by a roll coating method with a cylindrical applicator roll, wherein the ratio of the circumferential velocity of the cylindrical substrate to the circumferential velocity of the cylindrical applicator roll in said roll coating method is in the range of 0.7 to 1.4 during a coating stage during which the applicator is in contact with the cylindrical substrate and a coated cylindrical substrate is produced, and in the range of 1.2 to 15.0 in a subsequent after-coating stage during which the coating applicator is separated from the coated cylindrical substrate, the ratio of the circumferential velocity in the subsequent after-coating stage being larger than the ratio of the circumferential velocity during the coating stage, with the circumferential velocity of the cylindrical substrate being increased upon the separating motion, so as to not create a bridged structure of the coating solution between the cylindrical applicator roll and the cylindrical substrate.

2. The method for producing an electrophotographic photoreceptor of claim 1, wherein the coating solution for forming the charge generating layer is adjusted to have a viscosity of 10 mPa·s or below.

3. The method for producing an electrophotographic photoreceptor of claim 1, wherein the coating solution for forming the charge generating layer contains a solvent having a boiling point of 120° C. or more in a range from 5 to 40% by weight.

4. The method for producing an electrophotographic photoreceptor of claim 3, wherein the solvent having a high boiling point is composed of one or two or more of materials selected from the group consisting of cyclohexanone, pyrrolidone, and n-methyl pyrrolidone.

5. The method for producing an electrophotographic photoreceptor of claim 1, wherein in the ink-jet coating method, ejection of the coating solution for forming the charge generating layer is performed by a piezoelectric method.

6. A method for producing an electrophotographic photoreceptor that is obtained by coating on a cylindrical substrate or an intermediate layer formed on the cylindrical substrate, at least two layers: a charge generating layer containing a charge generating substance and a charge transporting layer containing a charge transporting substance, comprising the steps of:

forming the charge generating layer by applying a coating solution for forming the charge generating layer onto the cylindrical substrate or an intermediate layer formed on the cylindrical substrate by an ink-jet coating method; and forming the charge transporting layer by applying a coating solution for forming the charge transporting layer onto the charge generating layer by a roll coating method with a cylindrical applicator roll, wherein the ratio of the circumferential velocity of the cylindrical substrate to the circumferential velocity of the cylindrical applicator roll in said roll coating method is in the range of 0.7 to 1.4 during a coating stage during which the applicator is in contact with the cylindrical substrate and a coated cylindrical substrate is produced, and in the range of 1.2 to 15.0 in a subsequent after-coating stage during which the coating applicator is separated from the coated cylindrical substrate, the ratio of the circumferential velocity in the subsequent after-coating stage being larger than the ratio of the circumferential velocity during the coating stage, with the circumferential velocity of the cylindrical substrate being increased upon the separating motion, wherein the longitudinal axis of the cylindrical substrate is parallel to the longitudinal axis of the cylindrical applicator roll.

7. The method for producing an electrophotographic photoreceptor of claim 6, wherein the coating solution for forming the charge generating layer is adjusted to have a viscosity of 10 mPa·s or below.

8. The method for producing an electrophotographic photoreceptor of claim 6, wherein the coating solution for forming the charge generating layer contains a solvent having a boiling point of 120° C. or more in a range from 5 to 40% by weight.

9. The method for producing an electrophotographic photoreceptor of claim 8, wherein the solvent having a high boiling point is composed of one or two or more of materials selected from the group consisting of cyclohexanone, pyrrolidone, and n-methyl pyrrolidone.

10. The method for producing an electrophotographic photoreceptor of claim 6, wherein in the ink-jet coating method, ejection of the coating solution for forming the charge generating layer is performed by a piezoelectric method.

* * * * *